US006241234B1

(12) United States Patent
Saitoh et al.

(10) Patent No.: US 6,241,234 B1
(45) **Date of Patent: *Jun. 5, 2001**

(54) SHEET PROCESSING APPARATUS AND IMAGE FORMING APPARATUS USING SAME

(75) Inventors: Naho Saitoh, Toride; Yoshifumi Takehara, Abiko; Kazuyuki Iwamoto, Kashiwa; Kenichi Hayashi, Kashiwa; Wataru Kawata, Kashiwa, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/998,775

(22) Filed: Dec. 29, 1997

(51) Int. Cl.[7] ..... B65H 33/04; B65H 39/02; B65H 39/05; B65H 39/07

(52) U.S. Cl. ..... 270/58.12

(58) Field of Search ..... 355/324, 208, 355/206, 313, 207, 308; 399/410, 130; 270/53, 58.01, 58.11, 58.08, 58.12

(56) References Cited

U.S. PATENT DOCUMENTS 4,424,963 * 1/1984 Bartholet et al. ..... 270/53 X
4,782,363 * 11/1988 Britt et al. ..... 355/14 X
4,926,220 * 5/1990 Matysek et al. ..... 355/313 X
5,021,837 6/1991 Uto et al. .
5,177,548 * 1/1993 Nakamura et al. ..... 355/324
5,201,517 * 4/1993 Stemmle ..... 271/291 X
5,346,203 * 9/1994 Stemmle ..... 271/288 X
5,384,634 1/1995 Takehara et al. .
5,513,839 5/1996 Green .
5,573,233 11/1996 Hirai et al. .
5,580,039 12/1996 Takehara et al. .
5,709,376 * 1/1998 Ushirogata ..... 270/58.11

* cited by examiner

*Primary Examiner*—Christopher P Ellis
*Assistant Examiner*—Kenneth W Bower
(74) *Attorney, Agent, or Firm*—Fitzpatrick, Cella, Harper & Scinto

(57) ABSTRACT

A sheet processing apparatus has a first stacker for stacking discharged sheets; a feeder for feeding a set of sheets from the first stacker; and second stacker for stacking the set of sheets fed by the feeder. A shifting device shifts the sheets stacked on the first stacker and; a controller groups the sheets in a set into a plurality of groups of sheets, and stacks, shifts and feeds the sheets, for each group, to the first stacker, and stacks the set of sheets on the second stacker.

22 Claims, 29 Drawing Sheets

SHEET PROCESSING APPARATUS AND IMAGE FORMING APPARATUS USING SAME

FIELD OF THE INVENTION AND RELATED ART

The present invention relates to a sheet processing apparatus which is employed in, for example, a copying machine, a laser beam printer, or the like. More specifically, it relates to a sheet processing apparatus which comprises a first means (hereinafter, "processing tray") and a second means (hereinafter, "stacking tray"), for processing, for example, sorting or binding, the sheets discharged from the main assembly of an image forming apparatus.

In the past, a large number of inventions related to an apparatus constituted of a combination of a processing tray for stapling sheets as needed, and a stacking tray which receives and stores the sheets, have been submitted for a patent. One of such inventions is disclosed in U.S. Pat. No. 5,021,837. FIG. 38 is a schematic vertical section of the apparatus depicted in the invention.

In this drawing, referential figure 501 and 502 designate a processing tray and a stacking tray, respectively. Along the periphery of the processing tray, a stapler 503 for binding sheets, and a jogger 504 which shuttles in the direction perpendicular to the drawing to align sheets, are disposed.

With the provision of the above described structure, a set of sheets is discharged into the stacking tray 502 by a pair of sheet discharge rollers 505 and 506 after being aligned and stapled in the processing tray (stapling tray). The stacking tray 502 is enabled to alternately move frontward and backward (in the direction of sheet width) each time a stapled set of sheets is discharged into the stacking tray 502, so that the stapled sets of sheets are sorted as they are discharged into the stacking tray 502. It is also enabled to move vertically so that it aligns with the pair of discharge rollers 505 and 506 each time a stapled set of sheets is discharged. In other words, the stacking tray 502 gradually descends while alternately moving frontward and backward to sort the stapled sets of sheets.

Both the processing tray and the stacking tray 502 are slanted so that their downstream sides (left side of the drawing) are slightly higher. Therefore, the sheets are regulated, on the trailing edge side, by the trailing edge side wall 507.

As an image forming operation continues, the number of sheets which are discharged into, and stacked in, the stack tray 502 becomes large. As a result, the sheets in the bottom portion of the stack are subjected to a large amount of pressure generated by the weight of the sheets stacked above, hence the contact pressure between the trailing edges of the sheets in the bottom portion of the stack, and the trailing end wall 507, becomes very large. In the case of the apparatus based on the prior art, the stacking tray 502 is alternately moved frontward and backward in this condition, to sort the sheets. Therefore, the trailing edges of the sheets in the bottom portion of the stack are liable to sustain damages such as scratching, buckling, or the like anomalies, due to the friction between them and the trailing end wall 507.

Further, in the case of a sheet processing apparatus based on the prior art, each sheet is discharged without being aligned with the preceding sheets, and therefore, a sheet processing apparatus based on the prior art could be improved greatly in terms of sheet alignment.

Further, in the case of a sheet processing apparatus based on the prior art, when a large number of sheets is discharged one by one into a stacking tray to be aligned as a set of sheets, the sheets which are already in the stack tray are liable to be disturbed, and therefore, means for holding them down from above, or the like, is necessary.

SUMMARY OF THE INVENTION

Accordingly, the object of the present invention is to provide a sheet processing apparatus comprising a means for desirably stacking sheets, in terms of alignment.

According to an aspect of the present invention, there is provided a sheet processing apparatus comprising first stacking means for stacking sheets discharged thereto; feeding means for feeding a set of sheets from said first stacking means; second stacking means for stacking the set of sheets fed by said feeding means; shifting means for shifting the sheets stacked on said first stacking means; control means for grouping the sheet in a set into a plurality of groups of sheets, and stacking, shifting and feeding the sheets, for each group, to said first stacking means, and for stacking the set of sheets on said second stacking means.

According to another aspect of the present invention, there is provided a sheet processing apparatus comprising first stacking means for stacking sheets discharged thereto; feeding means for feeding a set of sheets from said first stacking means; second stacking means for stacking the set of sheets fed by said feeding means; shifting means for shifting the sheets stacked on said first stacking means; control means for grouping the sheet in a set into a plurality of groups of sheets, and stacking, shifting and feeding the sheets, for each group, to said first stacking means, and for stacking the set of sheets on said second stacking means, said control means controlling said shifting means to stack a set of sheets and a set of sheets at offset positions on said stacking means.

According to a further aspect of the present invention, there is provided a sheet processing apparatus comprising first stacking means for stacking sheets discharged thereto; feeding means for feeding a set of sheets from said first stacking means; second stacking means for stacking the set of sheets fed by said feeding means; aligning means for aligning the sheets stacked on said first stacking means; control means for grouping the sheet in a set into a plurality of groups of sheets, and stacking, aligning and feeding the sheets, for each group, to said first stacking means, and for stacking the set of sheets on said second stacking means.

As described above, according to the present invention, a sheet set to be transferred from the first stacking means to the second stacking means is shifted, relative to the immediately preceding set of sheets, prior to its transfer onto the second stacking means, so that it does not need to be shifted after it is transferred into the second stacking means. Therefore, such sheet misalignment that occurs when a set of sheets is shifted in the second stacking means of a processing apparatus based on the prior art can be prevented, and also, the power source for driving the sheet processing means can be reduced in size.

Further, according to the present invention, when a set of a large number of sheets is transferred from the first stacking means to the second stacking means, the sheet set is divided into a number of sub-sets comprising a smaller number of sheets, and then, each sub-set of sheets is separately transferred into the second stacking means, and therefore, even a plurality of sets of a large number of sheets can be desirably stacked in terms of sheet alignment within in each set, and in terms of their displacement in the alternate direction, relative to the adjacent sets.

Further, according to the present invention, when a set of sheets constituted of a large number of sheets is processed, the set is divided into two or more sub-sets constituted of a relatively small number of sheets, and then, each sub-set of sheets is aligned independently from other sub-sets, and then discharged. Therefore, two or more sets of sheets can be stacked in a desirably staggered arrangement.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Figure 35:
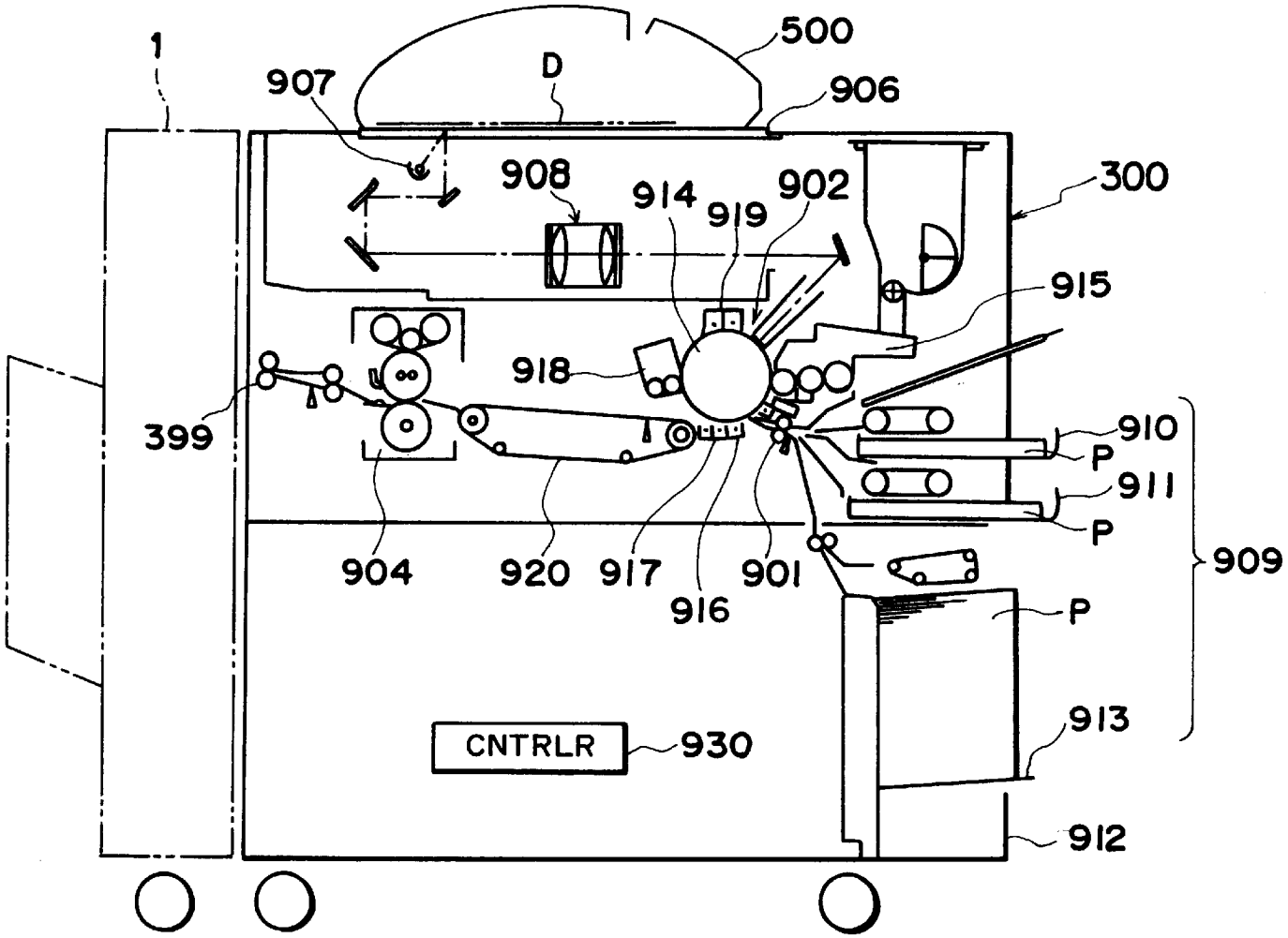
FIG. 35 is a schematic vertical section as seen from the front, of an image forming apparatus compatible with a sheet processing apparatus in accordance with the present invention.

FIG. 35 shows the main assembly of a typical image forming apparatus (main assembly of a copying machine) comprising a sheet processing apparatus in accordance with the present invention.

The main assembly of an image forming apparatus (main assembly of a copying machine) comprises a platen glass 906 as an original placement table, a light source 907, a lens system 908, a sheet feeding portion 909, an image forming portion 902, an automatic original feeding apparatus 500 for automatically delivering a sheet of original onto the platen glass 906, a sheet processing apparatus 1 which stacks the sheets discharged from the main assembly of the copying machine after an image is formed on the sheets, etc.

The sheet feeding portion 909 is constituted of cassettes 910 and 911, which store a plurality of recording sheets P, and are removably installable in the apparatus main assembly 300, and a deck 913 mounted on a pedestal 912. The image forming portion 902 is constituted of a cylindrical photosensitive drum 914, a developing device 915, a charger 916 for image transfer, a charger 917 for sheet separation, a cleaner 918, a primary charging device 919, and the like, wherein the photosensitive drum 914 is surrounded by the rest of the above devices. On the downstream side of the image forming portion 905, a conveying apparatus 920, a fixing apparatus 904, a discharge roller pair 905, and the like are disposed.

Next, the operation of this image forming apparatus will be described.

As a sheet feeding signal is outputted from a controlling apparatus 930 disposed on the apparatus main assembly 300 side, a sheet P is fed into the apparatus main assembly from the cassette 910, the cassette 911, or the deck 913. Meanwhile, an original D on the original placement table 906 is illuminated by the light source 907, and the light reflected by the original D is projected onto the photosensitive drum 914 which is charged by the primary charging device 919 prior to its exposure to the reflected light from original D, through the lens system 908. As the photosensitive drum 914 is exposed to the light reflected by the original D, an electrostatic latent image is formed on the photosensitive drum 914, and this electrostatic latent image is developed by the developing device 915 into a toner image.

The sheet S fed from the sheet feeding portion 909 is straightened by a registration roller 901 in terms of its angle relative to the direction in which the sheet S is fed, and then is conveyed to the image forming portion 902 in synchronism with the toner image also by the registration roller 901. In the image forming portion 902, the toner image on the photosensitive drum 914 is transferred onto the sheet S by the charging device 916 for image transfer. After the toner image is transferred onto the sheet S, the sheet S is charged to the polarity opposite to the polarity to which the sheet S is charged by the charging device 916 for image transfer. As a result, the sheet S is separated from the photosensitive drum 914.

After its separation from the photosensitive drum 914, the sheet S is conveyed to the fixing apparatus 904 by the conveying apparatus 920. In the fixing apparatus 904, the toner image on the sheet S is permanently fixed to the sheet S. The sheet S with the permanently fixed toner image is discharged from the apparatus main assembly 300 by the discharge roller pair 905.

After a permanent image is formed on the sheet S fed into the apparatus main assembly 300 from the sheet feeding portion 909, the sheet S is discharged into the sheet processing apparatus 1 in accordance with the present invention.

Next, the embodiments of the present invention will be described with reference to the drawings.

Figure 1:
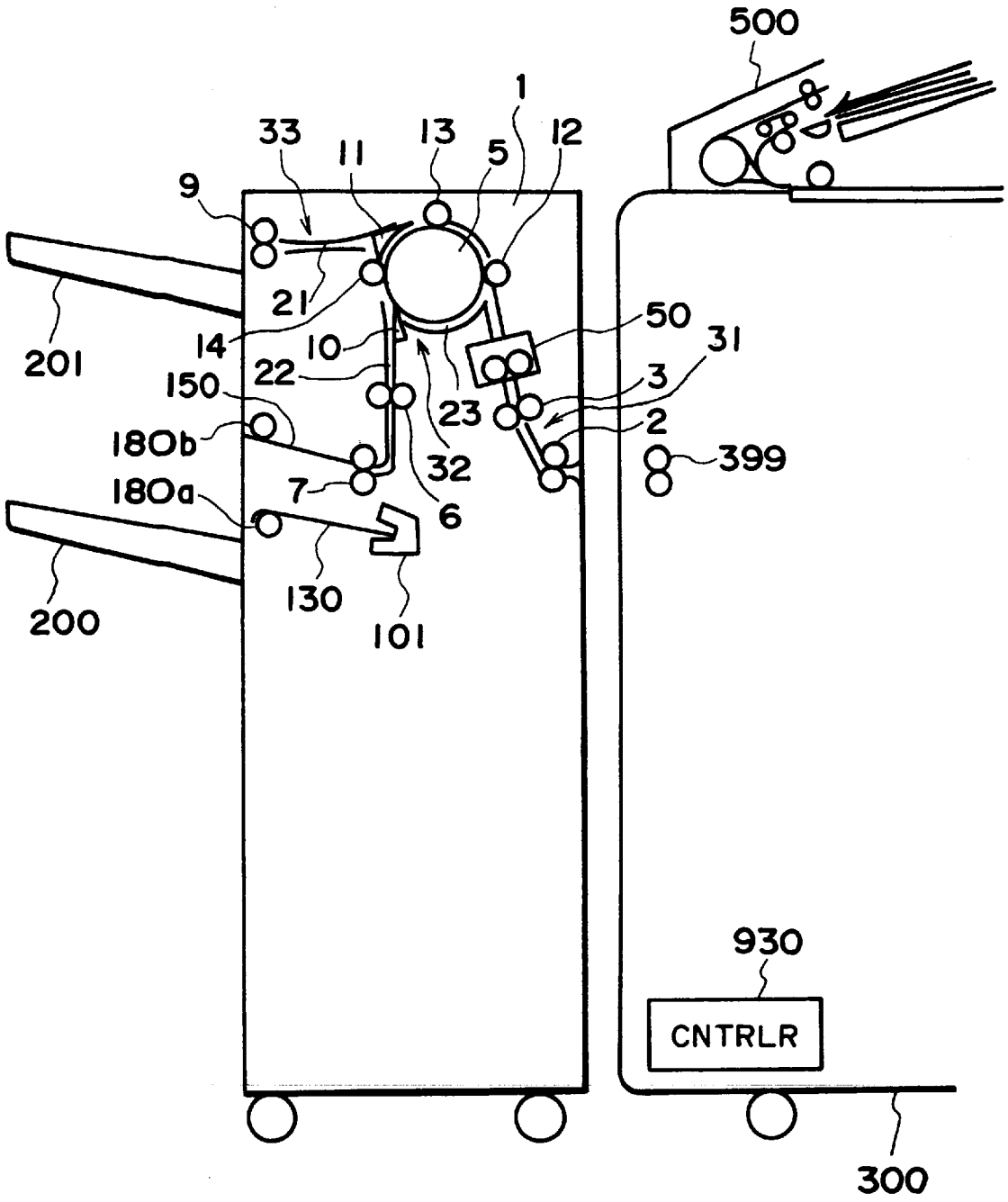
FIG. 1 is a vertical section of the sheet processing apparatus in an embodiment of the present invention, and depicts the general structure of the apparatus.
Figure 12:
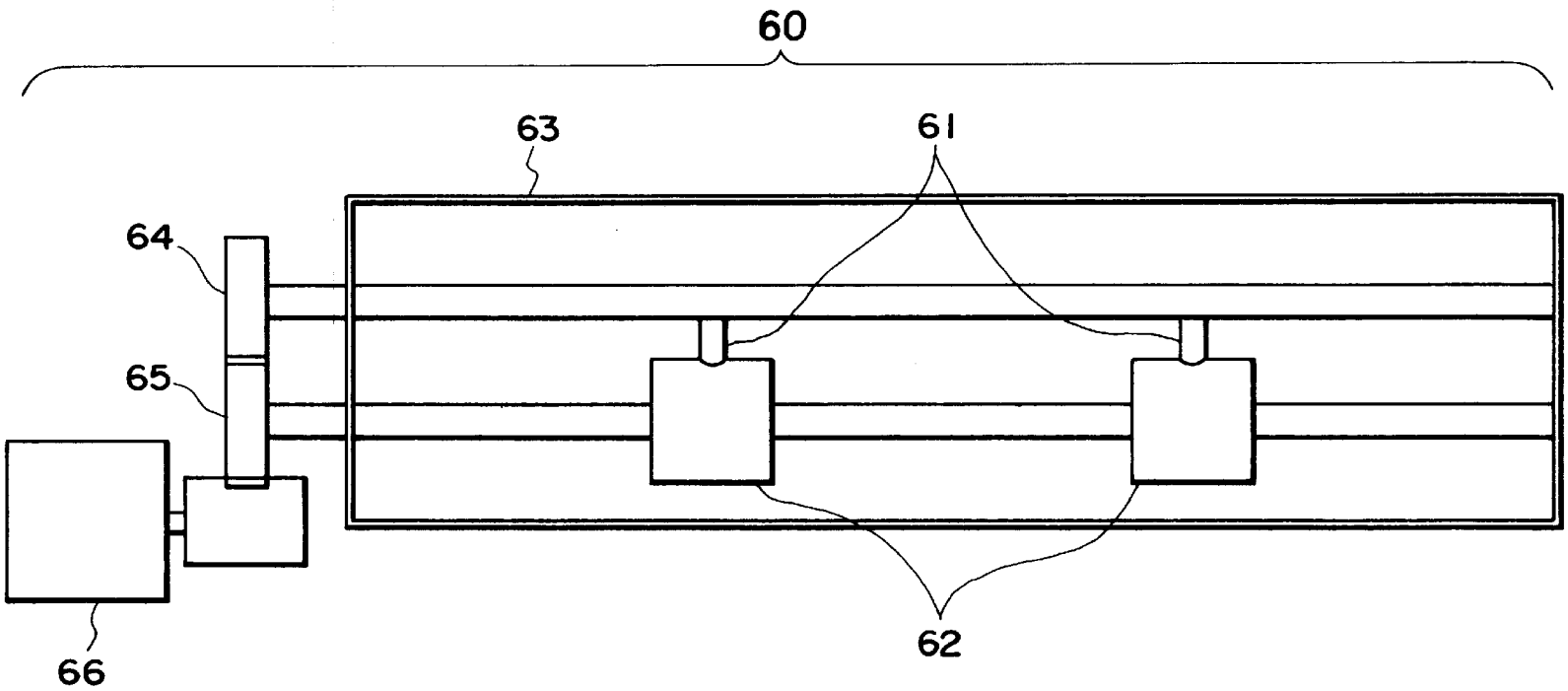
FIG. 12 is a top view of the punching unit in the apparatus illustrated in FIG. 1.

In FIG. 1, referential figures 1 and 300 designate a finisher, and the main assembly of an image forming apparatus. Here, the detailed description of the apparatus main assembly 300 and the RDF will be not be given. A referential figure 399 designates a discharger roller pair; 2, the entrance roller pair of the finisher 1; 3, a conveyer roller pair; 31, a sheet detection sensor; 50, a hole punch unit for punching a hole in the delivered sheet, along the trailing edge of the sheet; and a referential figure 5 designates a large conveyer roller which conveys the sheet, in cooperation with holding rollers designated by the referential figures 12, 13, and 14.

Figure 10:
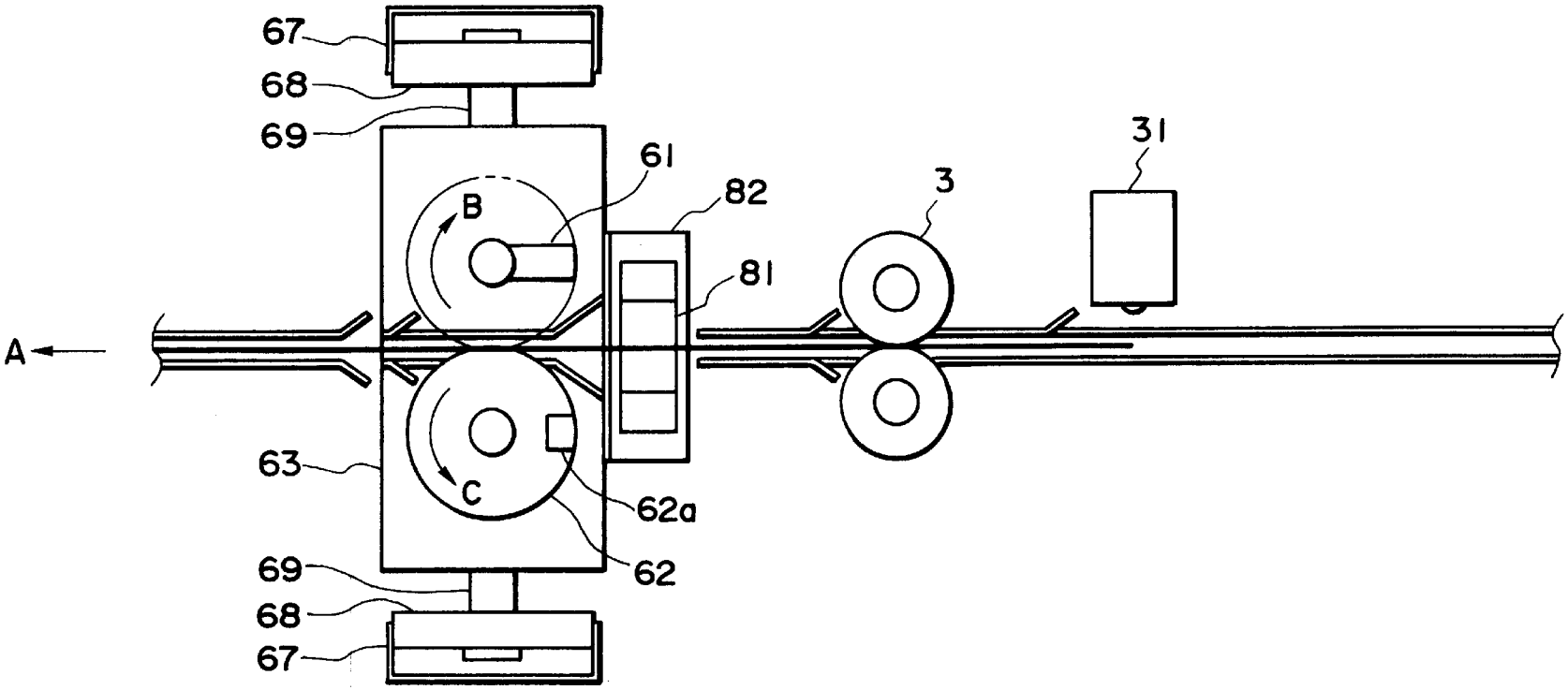
FIG. 10 is a side view of the punching unit in the apparatus illustrated in FIG. 1.
Figure 11:
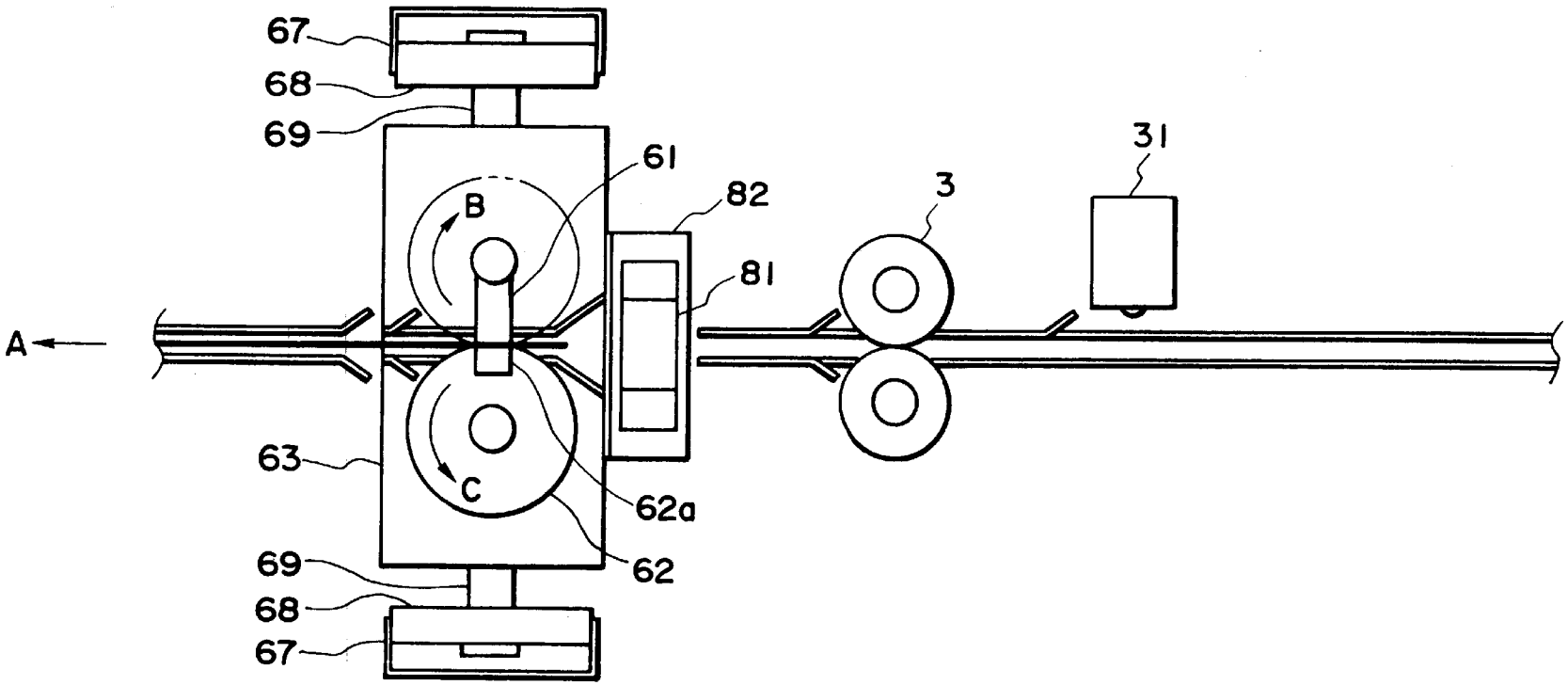
FIG. 11 is also a side view of the punching unit in the apparatus illustrated in FIG. 1.

Designated by a referential figure 11 is a flapper which switches the sheet path between a non-sorting path 21 and a sorting path 22. A referential figure 10 designates a flapper which switches the sheet path between the sorting path 22, and a buffer path 23 for the temporarily holding the sheet. A referential figure 6 designates a conveyer roller pair; 130, and intermediary tray (hereinafter, "processing tray") which temporarily accumulates sheets, aligns them, and staples them; 7, a discharge roller pair for discharging the sheet onto a processing tray (first stacking tray) 130; 150, an oscillating guide; 180*a* and 180*b*, sheet set discharge rollers, which are supported on the processing tray 130 and the oscillating guide 150, respectively, and coordinate with each other, as means for discharging a sheet set, to convey the sheets on the processing tray 130 when the oscillating guide 150 is at the closed position; a reference figure 200 designates a stacking tray (second stacking tray).

Figure 2:
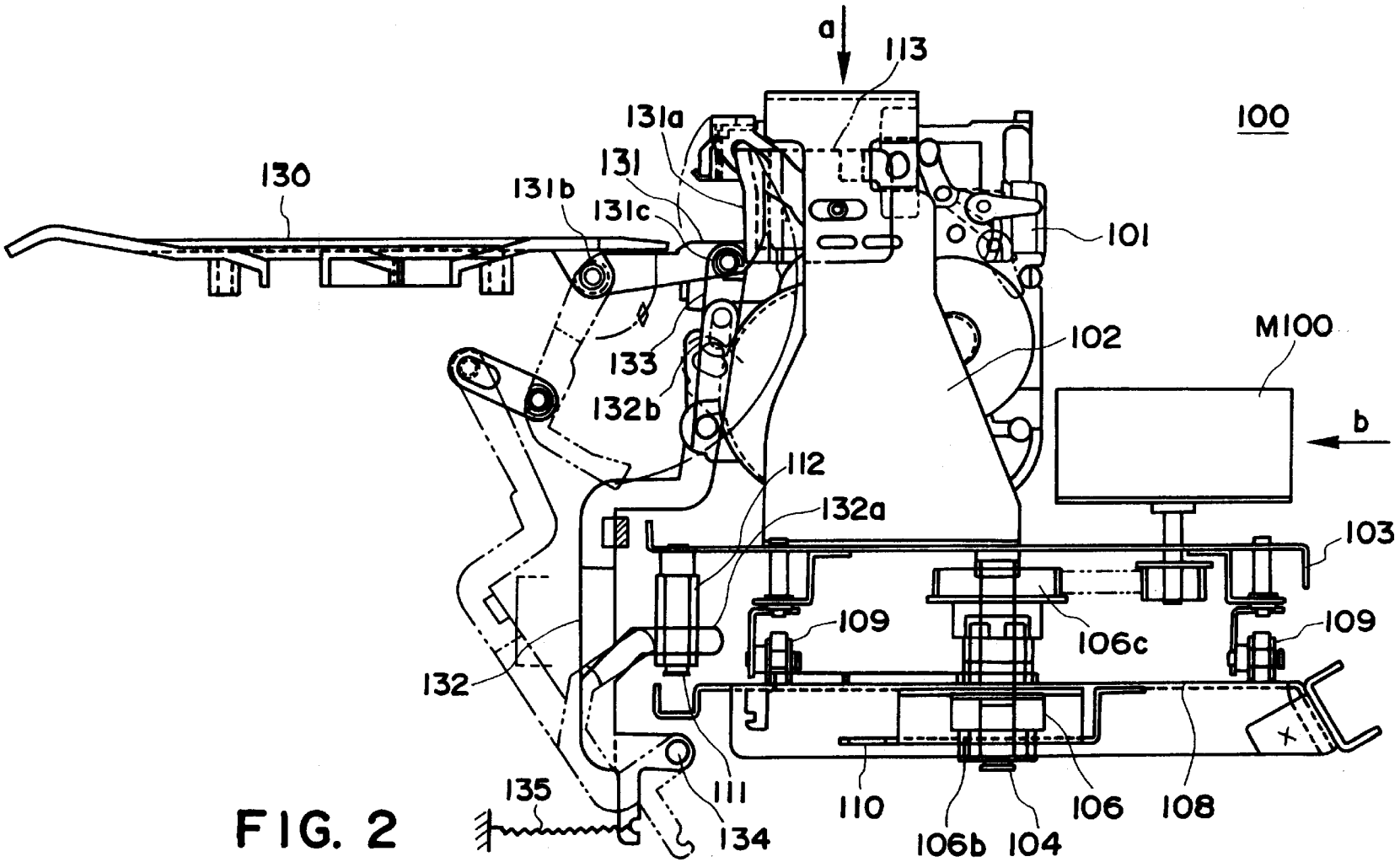
FIG. 2 is a vertical drawing as seen from the front side of the apparatus, of the stapler, the processing tray, and their adjacencies, in the apparatus illustrated in FIG. 1.
Figure 3:
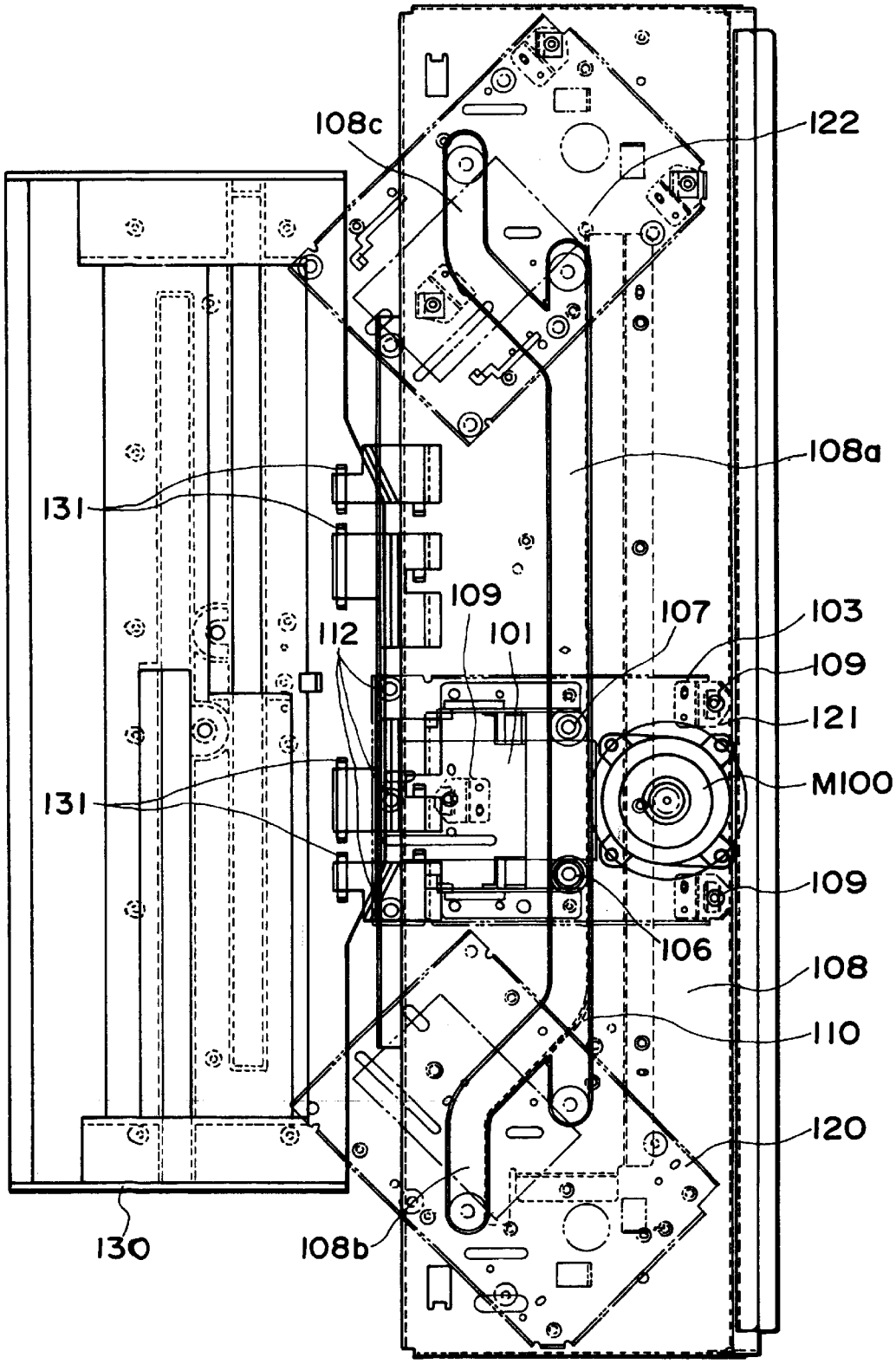
FIG. 3 is a drawing as seen from the direction of an arrow mark a in FIG. 2, of the stapler, the processing tray, and their adjacencies, in the apparatus illustrated in FIG. 1. It depicts the mechanism for moving the stapler.
Figure 4:
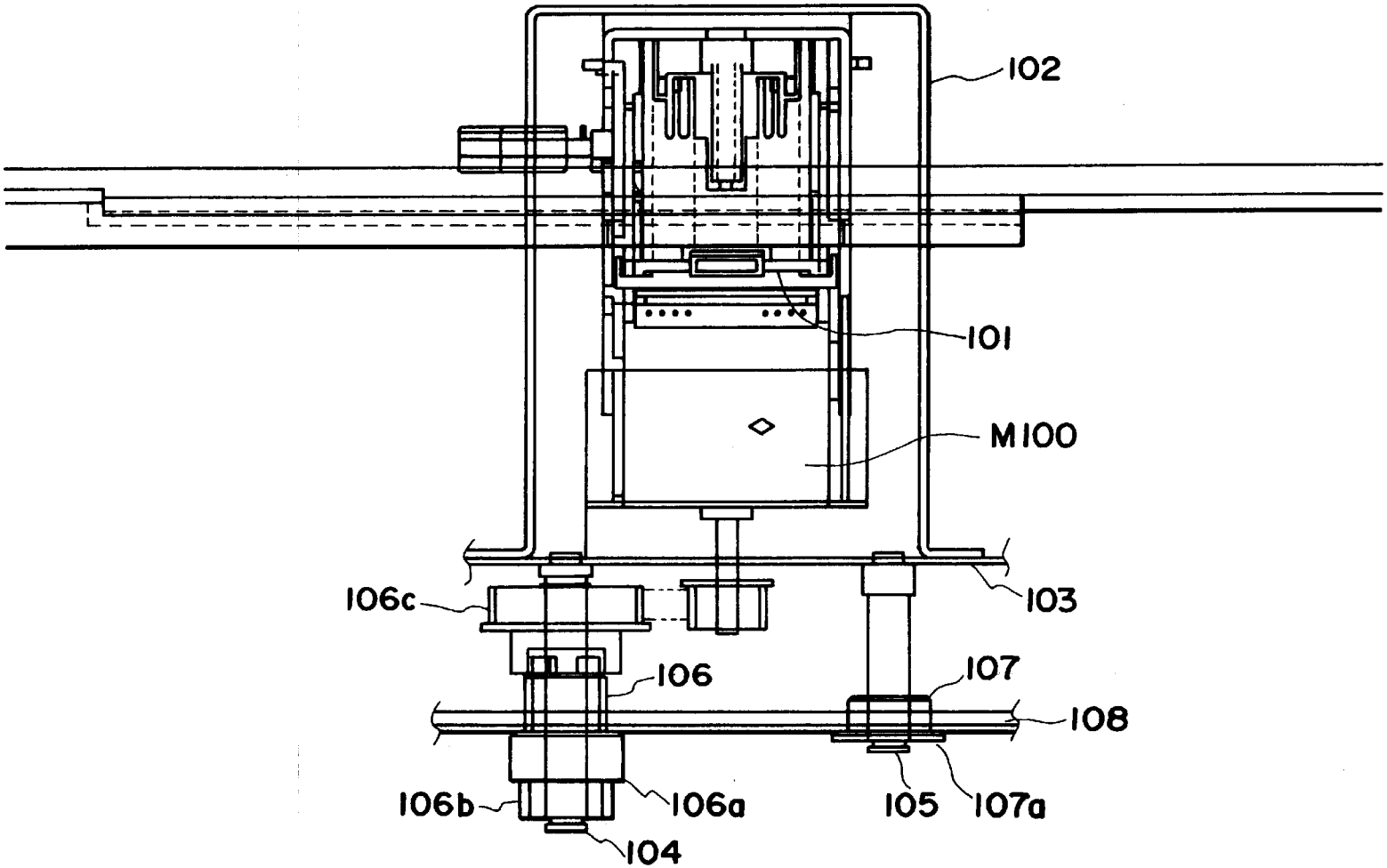
FIG. 4 is a drawing as seen from the direction of an arrow mark b in FIG. 2, of the stapler and the adjacencies thereof, in the apparatus illustrated in FIG. 1. It depicts the back site of the stapler.

Next, the stapling unit 100 will be described with reference to FIG. 2 (vertical drawing). FIG. 3 (horizontal drawing as seen from the direction of an arrow mark a), and FIG. 4 (vertical drawing as seen from the direction of the arrow b in FIG. 2).

A stapler (binding means) 101 is fixed to a movable base 103, with the interposition of a holder 102. On axes 104 and 105 fixed to the movable base 103, rollers 106 and 107 are rotatively mounted, and the rollers 106 and 107 are fitted in an elongated track, or hole, (tracks 108*a*, 108*b*, and 108*c*) cut in a guide plate 108.

The rollers 106 and 107 have flanges 106*a* and 107*a*, respectively, the diameters of which are larger than the width of the track of the guide plate 108. The movable base 103 also comprises three guide rollers 112, which are attached to the underside of the movable base 103, and rollers 109, which also are attached to the underside of the movable base 103. Thus, the movable base 103 which holds the stapler 101 can smoothly move following the tracks (108*a*, 108*b*, and 108*c*) of the guide plate 108, without ever coming off the track.

The aforementioned track hole (108*a*, 108*b*, and 108*c*) has a spur track parallel to the main track, at both the front and rear ends. With this arrangement, as the stapler 101 is moved to the front, it becomes diagonally positioned relative to the sheet edge since the roller 106 moves into the spur track 108*b* and the roller 107 remains in the main track 108*a,* whereas when it is at the center, it is parallel to the sheet edge since both rollers 106 and 107 remain in the main track 108*a*.

As the stapler 101 is moved to the rear, it becomes diagonally positioned, relative to the sheet edge, in the direction opposite to the diagonal direction in which the stapler is positioned at the front of the apparatus, since the roller 106 remains in the main track 108*a,* and the roller 107 moves into the spur track 108*c*.

After the two rollers 106 and 107 move into the correspondent spur tracks, the stapler is moved holding the diagonal orientation. The operation for changing the orientation of the stapler 101 is triggered by an unillustrated cam.

Next, the mechanism for moving the stapler 101 will be described.

The roller 106, one of the rollers of the movable base 103, integrally comprises a pinion gear 106*b* and a belt pulley 106*c*. The pinion gear 106*b* is linked to the motor M100, with a belt stretched between the pulley 106*c* and the pulley of the motor M100. To the bottom surface of the track plate 108, a rack gear 110, which engages with the pinion gear 106*b,* is fixed along the track. With this arrangement, as the motor M100 is rotated forward or backward, the movable base 103 is moved frontward or rearward, holding the stapler 101.

To the bottom surface of the movable base 103, axes 111 are attached, which extend downward. Around each axis 111, the aforementioned roller 112 is fitted, which plays a role in rotating the trailing end stopper 131 of the processing tray 130, which will be described later, so that the stopper 131 is prevented from colliding with the stapler 101. The details of this arrangement will be described next.

The stapler unit 100 comprises a sensor for detecting the home position of the stapler 101. Normally, the stapler 101 is on standby at the home position (in this embodiment, the most front position).

Now, the trailing end stopper 131 which holds the trailing edges of the sheets P stacked in the processing tray 130 will be described.

The trailing end stopper 131 comprises: a sheet holding surface 131*a,* which is perpendicular to the stacking surface of the processing tray 130 when the stopper 131 is erected; a pin 131*b* which is inserted in the round hole of the processing tray 130 to rotatively attach the stopper 131 to the processing tray 130; and a pin 131*c* which connects the stopper 131 to a linkage which will be described later. The linkage comprises a main link 132 and a sub-link 133. The main link 132 has a cam surface 132*a* which is pushed by the roller 112 attached to the movable base 130 for the stapler 101. The sub-link 133 connects the top end pin 132*b* of the main link 132 and the pin 131*c* of the trailing end stopper 131*c*.

The main link 132 swings around a shaft 134 fixed to an unillustrated frame. To the bottom end of the main link 132, a tension spring 135 is attached to generate tension to rotate the main link 132 in the clockwise direction, and therefore, the main link is normally kept in contact with a bumper plate 136, keeping thereby the trailing end stopper 131 perpendicular to the processing tray 130.

As the movable staple base 103 is moved, the pusher roller 112 attached to the movable staple base 103 is caused to push the cam surface 132*a* of the main link 132 connected to the trailing end stopper 131 which is blocking the path of the stapler 101. As a result, the trailing end stopper 131 is pulled, being thereby rotated downward, by the sub-link 133 to a location at which it does not interfere with the stapler 101. In order to make sure that the trailing end stopper 131 is kept at the collision avoidance position while the stapler is moving, two or more pusher rollers 112 are provided (three, in this embodiment).

To each of the front and rear plates of a stapler holder 102 for supporting the stapler 101, a stopper 113 (outlined with a double dot chain line) is attached, the surface of which on the processing tray side is contoured like the surface of the trailing end stopper 131. Therefore, even when the stapler 101 is at the center position (center of the track 108*a*), hence the trailing end stopper 131 is at the collision avoidance position, the trailing edges of the sheets are properly held by the stopper 113 of the stapler holder 102.

Next, referring to FIG. 5, a description will be given as to a processing tray unit 129.

The processing unit 129 is disposed between a conveyer portion for conveying the sheets from the main assembly 300 of an image forming apparatus toward the stacking tray 200, and the stacking tray 200 which receives and stores the processed sets of sheets.

The processing tray unit 129 is constituted of the processing tray 130, the trailing end stopper 131, an aligning means 140, the oscillating guide 150, a sheet paddling member 160, a shuttling tray 170, and a sheet set discharge roller pair 180.

The processing tray 130 is slanted, with the downstream side (left side of the drawing) being the higher side, and the upstream side (right side of the drawing) being the lower side. To the lower side, the trailing end stopper 131 is attached. After being discharged by the discharge roller 7 of the conveyer portion, the sheet P slides on the processing tray 130, due to its own weight, and also by the function of the sheet paddling member 160, which will be described later, until its trailing edge comes in contact with the trailing end stopper 131.

To the higher end portion of the processing tray 130, the sheet set discharge roller 180*a* is attached, and to the oscillating guide 150, which will be described later, the sheet set discharge roller 180*b,* which makes contact with the sheet set discharge roller 180*a,* is attached. Both rollers 180*a* and 180*b* are rotatively drivable in the forward or backward direction by a motor M180.

Next, the aligning wall (sheet aligning means) 140 will be described with reference to FIG. 6 which is the drawing of the aligning wall 140 as seen from the direction of an arrow mark c in FIG. 5.

Aligning members 141 and 142 constitute the aligning means. The aligning member 140 is the front one, and the aligning means 142 is the rear one, and they are independently movable in the forward or rearward direction. Both the front aligning member (first aligning member) and the rear aligning member (second aligning member) comprise: portions with aligning surfaces 141*a* and 142*a,* respectively, which stand upright relative to the sheet supporting surface of the processing tray130, and press the lateral edges of the sheets; portions with sheet supporting surfaces 141*c* and 142*c,* which are perpendicular to the aligning surfaces 141*a* and 141*b,* respectively, and support the sheet P from below; and gear portions with rack gears 141*b* and 142*b,* respectively, which extend in the front to rear direction in parallel to the sheet supporting surface of the processing tray 130. The two aligning members are fitted in correspondent guides which extend in the direction perpendicular to the sheet conveyance direction, with the aligning surfaces 141*a* and 142*a* standing upright above the sheet supporting surface of the processing tray 130, and the gear portion sticking downward below the bottom surface of the processing tray 130.

The rack gears 141*b* and 142*b* are meshed with correspondent pinion gears 143 and 144, respectively, which are linked to motors M141 and M142, respectively, through the pulleys and belts. Thus, as the motors are rotated forward or backward, the aligning members 141 and 142 are moved frontward or backward. Both aligning members 141 and 142 are provided with home position sensors S1 and S2, respectively, and normally, both are on standby at their home positions.

In this embodiment, the home position of the front aligning member 141 is the most front position, and the home position of the rear aligning member 142 is the rearmost position.

The downstream side (left side of the drawing) of the oscillating guide 150 supports the aforementioned sheet set discharge roller 180*b,* and the upstream side (right side of the drawing) of the oscillating guide 150 is supported by an axis 151. Normally, when sheets P are discharged one by one into the processing tray 130, the oscillating guide 150 remains at an open position, at which the sheet set discharge rollers 180*a* and 180*b* remain separated from each other, being thereby prevented from interfering with the sheets P while the sheets P are discharged, fall into the processing tray 130, and are aligned, whereas when the sheets P are discharged all together as a set of sheets from the processing tray 130 into the stacking tray 200, the oscillating guide 150 remains at a closed position, at which the sheet discharge rollers 180*a* and 180*b* remain in contact with each other.

A rotative cam 152 is disposed immediately below the lateral edge of the oscillating guide 150. As the rotative cam 152 is rotated, it makes contact with the lateral edge of the oscillating guide 150, and pushes up the oscillating guide 150, causing the oscillating guide 150 to pivot about the axis 151, in other words, open up. Then, as the rotative cam 152 is rotated 180° from the point at which the oscillating guide 150 begins to open, the rotative cam 152 separates from the lateral edge of the oscillating guide 150, allowing thereby the oscillating guide 510 to close. The rotational movement of the rotative cam 152 is caused by a motor M150 linked to the rotative cam 152 through a driving system.

The home position of the oscillating guide 150 is the position at which it is open, and in order to determine whether the oscillating guide 150 is at the home position or not, the apparatus is provided with a sensor S3.

Next, the sheet paddling member 160 will be described.

The sheet paddling member 160 is solidly attached to an axis 161, and the axis 161 is rotatively supported by the front and rear panels, and is linked to a motor M160, which rotates the sheet paddling member 160 in the counterclockwise direction. The length of the sheet paddling member 160 is rendered slightly longer than the distance between the axis 161 and the sheet supporting surface of the processing tray 130. The home position for the sheet paddling member 160 is set at a position (outlined by a solid line in FIG. 5) at which the sheet paddling member 160 does not come in contact with the sheet P when the sheet P is discharged into the processing tray 130 by the discharge roller pair. The sheet P is discharged, with the sheet paddling member 160 being at the home position. As the sheet P lands in the processing tray 130, the sheet paddling member 160 is rotatively driven by the motor M160 in the counterclockwise direction, paddling the sheet P toward the trailing end stopper 131, and thereby, making sure that the trailing edge of the sheet P squarely comes in contact with the trailing end stopper 131. Then, the sheet paddling member 160 is rotated back to the home position after a predetermined interval, and then, remains at the home position, on standby for the next sheet discharge.

Figure 7:
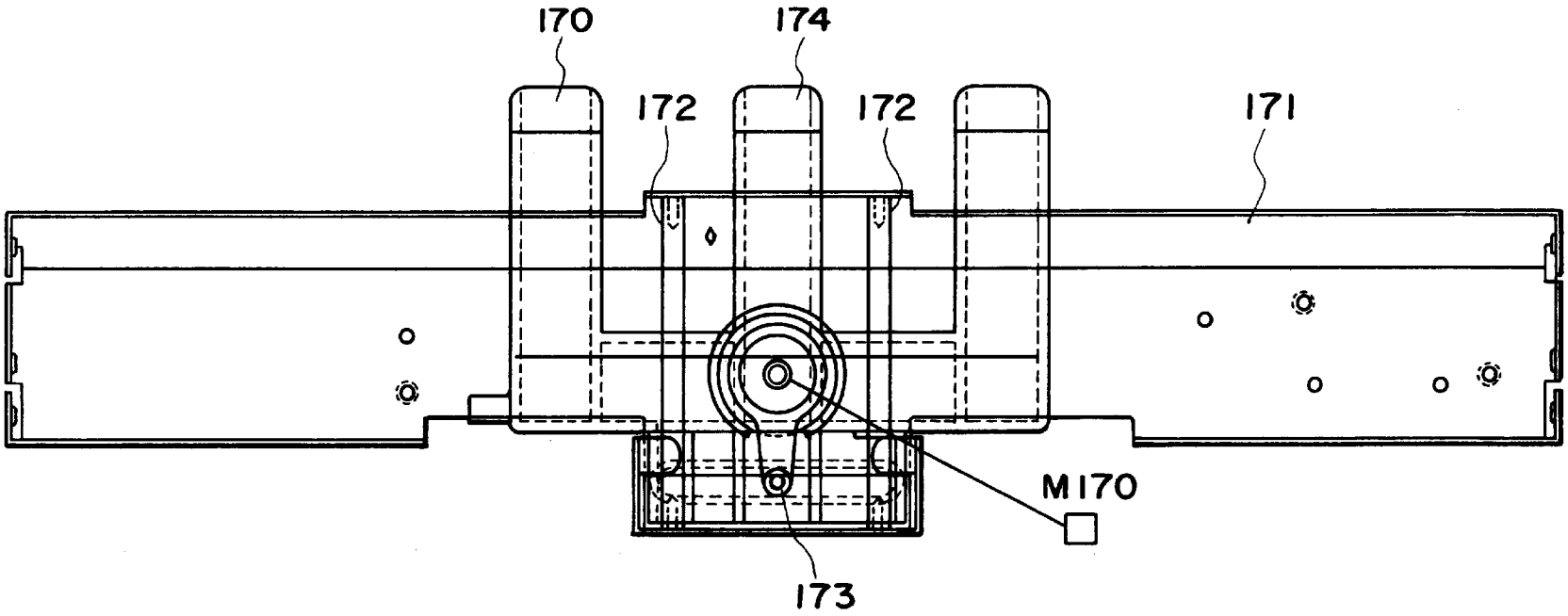
FIG. 7 is a horizontal drawing of a shuttling tray in the apparatus illustrated in FIG. 1.

Next, the shuttling tray 170 will be described with reference to FIG. 7 which is the drawing of the shuttling tray 170 as seen from the direction of an arrow mark d in FIG. 5.

The shuttling tray 170 is located below the sheet set discharge roller 180*a,* and moves in or out in the sheet conveyance direction (direction indicated by an arrow mark x in FIG. 5), substantially in parallel to the lateral edge of the inclined processing tray 130. When the shuttling tray 170 is out (outlined by a double dot chain line in FIG. 5), its edge on the downstream side relative to the sheet discharge direction is above the approximate center of the stacking tray 200, and when it is in, or retracted, (outlined by a solid line in FIG. 5), the same edge is on the right-hand side of the sheet set discharge roller pair. It should be noted here that the processing tray unit 129 is so structured that when the shuttling tray 170 is out, it reaches far enough to prevent the gravitational center of the sheet P from going beyond the downstream edge of the tray 170, relative to the sheet discharge direction, as the sheet P is discharged into the processing tray 130.

The shuttling tray 170 is supported by a rail 172 fixed to a frame 171, and is rendered movable in the sheet discharge direction. More specifically, a rotational link 173, which rotates about an axis 174, is fitted in the grooves provided on the bottom surface of the shuttling tray 170. Therefore, as the rotational link 173 rotates once, the shuttling tray 170 shuttles once as described above.

The rotational link 173 is driven by a motor M170 through an unillustrated driving mechanism. The home position for the shuttling tray 170 is the "in" position (outline by a solid line in FIG. 5), and whether or not the shuttling tray 170 is at the home position is detected by an unillustrated sensor.

Figure 8:
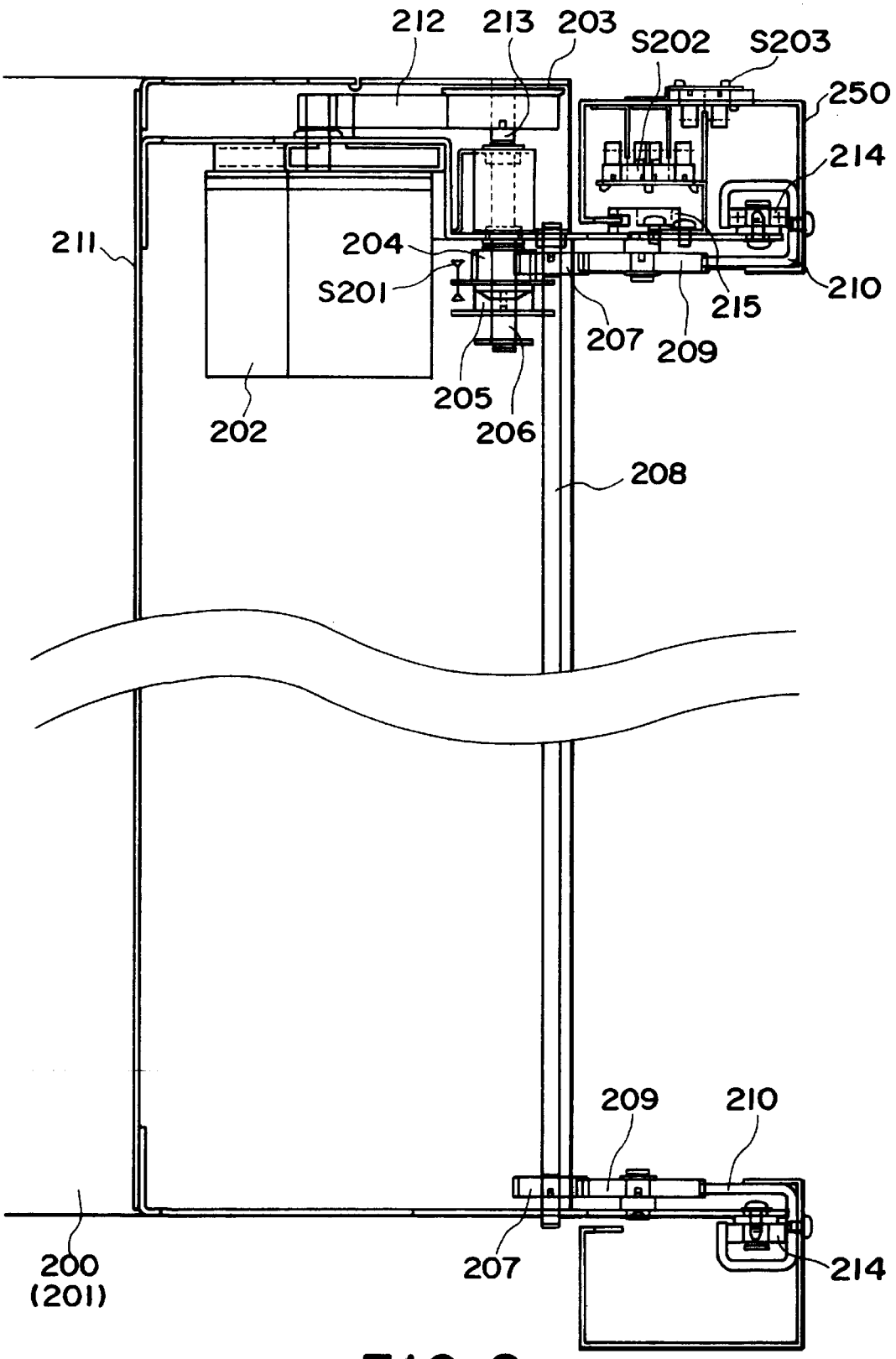
FIG. 8 is a horizontal drawing of the stacking tray in the apparatus illustrated in FIG. 1.
Figure 9:
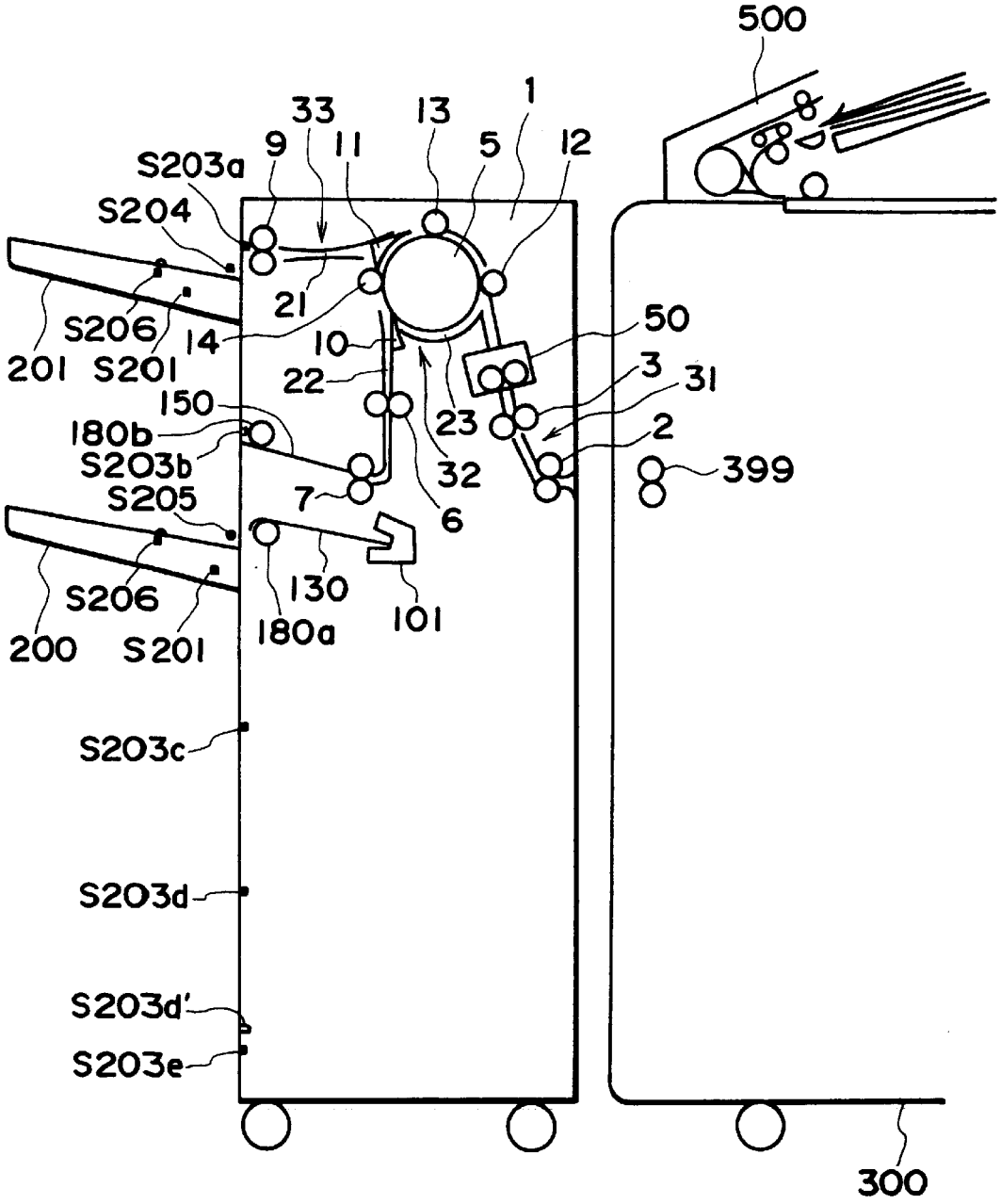
FIG. 9 is a schematic vertical section of the processing apparatus in the first embodiment of the present invention, and shows the locations of the sensors disposed around the stacking tray.

Next, the stacking tray 200 and a sampling tray 201 will be described with reference to FIGS. 8 and 9.

The two trays are optionally employed depending on the situation. The stacking tray 200, which is located below the sampling tray 201, is selected while a copying machine, a printer, and the like machine is in an ordinary operation, whereas the sampling tray 201, which is above the stacking tray 200, is selected when the image forming apparatus is in an optional operation, for example, when the apparatus is in a sampling mode, an interrupting mode, an overflowing mode, that is, when the stacking tray is full, a sorting mode, a mixed output mode, or the like.

Both trays are each provided with a stepping motor 202 so that they can be vertically moved independently from each other. Each tray is attached to the sheet processing apparatus by means of fitting a roller 214 (total of four, two on each side of the tray) attached to the downstream edges of the tray, in a vertical roller track fixed to the frame of the sheet processing apparatus 1. The vertical edge of the vertical roller track constitutes a rack 210. The play between the tray and the frame 250 of the sheet processing apparatus 1 in the front to rear direction of the apparatus is regulated by a regulating member 215. The stepping motor 202 is attached to the base plate 211 of the tray, and a pulley is press-fitted around the shaft of the stepping motor 202. This pulley is linked to a pulley 203 with a timing belt 212 to transmit driving force from the motor 202 to the pulley 203.

The pulley 203 is fixed to an axis 213 with the use of a parallel pin, and the axis 213 is fixed to a ratchet 205 also with the use of a parallel pin. The ratchet 205 remains in contact with an idler gear 204 due to the pressure from a spring 206, and the idler gear 204 is meshed with a gear 207. The gear 207 is meshed with a gear 209 which is meshed with the rack 210. Further, the gear 207 is fixed to an axis 208 to which the gear 207 on the opposite side of the tray is fixed, so that the driving force of the motor 202 is transmitted to both sides of the tray. Further, each tray is fixed to its own base plate 211, constituting a tray unit.

In order to prevent the tray driving system from being damaged by foreign objects pinched by the tray driving system when the tray is descending, the tray driving system is designed so that the aforementioned ratchet is allowed to slip on the surface of the idler gear 204 against the pressure from the spring 206, only in the direction in which the ratchet 205 rotates when raising the tray. If the slipping of the ratchet 205 begins, the motor 202 must be immediately stopped. In order to detect the slipping of the ratchet 205, the apparatus is provided with a sensor S201, which detects the slit provided in the idler gear 204. This sensor S201 doubles as an synchronism sensor. Also, in order to allow the tray to vertically move across the processing tray portion which has the opening which the processing tray 130 faces, the oscillating guide 150 is designed so that when it is at the closed position, its portion becomes a part of the accumulating wall of the tray: in other words, the tray is allowed to move only when a sensor (unillustrated) detects that the oscillating guide 150 is at the closed position.

A sensor S202 is an area detection sensor, which detects flags present in the area between an upper limit sensor 203*a* for preventing the excessive ascending of the tray, and a sensor S205 for detecting the top of the stack of sheets in the processing tray 130. A sensor S203*b* for detecting the thousandth sheet on the sample tray is disposed at a location, the distance from which to a sensor S204 for detecting the surface of the sheet which comes through the non-sorting path is equivalent to the thickness of a stack of 1,000 sheets, to use the height of the sheet stack to limit the number of sheets which are allowed to be stacked in the sampling tray 201.

A sensor 203*c* is for using the height of the stack of the sheet sets in the sampling tray 201 to limit the number of the sheet sets allowed to be discharged into the sampling tray 201 from the processing tray 130. It is disposed at a location, the distance from which to a sensor S205 for detecting the surface of the sheet which comes through the sorting path is also equivalent to the thickness of a stack of 1,000 sheets. A sensor S203*d* is for using the height of the stack of the sheet sets in the stack tray 200 to limit thenumber of the sheet sets allowed to be discharged into the stacking tray 200 from the processing tray 130. It is disposed at a location, the distance from which to the sensor S205 for detecting the surface of the sheet which comes through the sorting path is equivalent to the thickness of a stack of 2,000 sheets. A sensor S203*e* is a lower limit sensor for preventing the excessive descending of the stacking tray 200. Among the above described sensors, only the sheet surface detection sensors S204 and S205 are of a front-to-rear transmission type. Further, each tray is provided with a sensor 206 which detects whether or not a sheet is in the tray.

As for a method for detecting the position of the top sheet, first, the tray is raised from below each sensor until the sensor is blocked. This is the initial point. Then, after sheets are stacked, the tray is lowered until the optical axis of the top sheet sensor becomes unblocked. Thereafter, the tray is raised again until the optical axis of the top-sheet sensor is blocked. This procedure is repeated.

Next, the hole punching unit 50 will be described.

The hole punching unit 50 is constituted of a hole punching means 60 and a lateral edge detecting means 80. The hole punching means 60 has a hole punch 61 and a die 62, which are axially supported by a casing 63, with the gear of the punch 61 meshing with the gear of the die 62 so that as they are driven by a punch driver motor 66, they are synchronously driven in the directions of arrow marks B and C, respectively. When not in operation, they are at their home positions (H.P.) as illustrated in FIG. 10. When in operation, after the sheet detection sensor 31 detects the trailing edge of the sheet, the punch driver motor 66 is driven with predetermined timing. Then, the punch 61 and the die 62 are rotated in the directions of the arrow marks B and C, respectively, and the punch 61 meets with a die hole 62*a* of the die 62, punching a hole through a sheet which is being conveyed.

In order that a hole can be punched through a sheet while the sheet is being conveyed, the rotational speeds of the punch 61 and the die 62 are rendered the same as the rotational speed of the aforementioned conveyer roller pair 3. A referential FIG. 67 designates a guide portion for moving the hole punching means 60 in the direction perpendicular to the sheet conveyance direction A, and a referential FIG. 68 designates a roller which rotates in contact with the guide portion 67. The roller 68 is mounted on a roller shaft 69 which is attached to the casing 63 by crimping.

A reference 63*a* designates a rack gear cut along the edge of the casing 63. It is meshed with a pinion gear 70 attached to an unillustrated motor for moving the hole punching means. A reference 71 designates a sensor for detecting whether or not the hole punching means is at the initial position. It has a light receptor portion 71*a* aligned in parallel to the sheet conveyance direction A, and is attached to the casing 63.

With the above arrangement, the hole punching means 60 is drivable in the direction indicated by arrow marks D or E, that is, the direction perpendicular to the sheet conveyance direction A, by the hole punching means moving motor. As the hole punching means initial position detecting sensor 71 is moved in the arrow E direction, a marker 52 for the initial point for the hole punching means is detected by the light receptor portion 71*a*. The initial position for the hole punching means is set at a point away from the referential sheet edge position by several millimeters which correspond to the amount of the possible positional deviation of the sheet, for example, slanting or lateral deviation.

The lateral edge detecting means 80 is attached to the hole punching means 60. The lateral edge detecting means 80 is constituted of a sensor 81 for detecting the lateral edge of a sheet, and a sensor arm 82, to the end of which the sensor 81 is attached. The sensor 81 has a light receptor portion 81*a* aligned in parallel to the sheet conveyance direction A.

A portion of the sensor arm 83 constitutes a rack gear 82*a*, which is meshed with a pinion gear 83 fixed to an unillustrated motor for moving the lateral edge detecting means 80. This unillustrated motor is attached to the casing 63. To the rear end of the sensor arm 82, a sensor 84 for detecting the initial position of the lateral edge of the sheet is attached. The sensor 84 has a light receptor portion 84*a* aligned in parallel to the light receptor 81*a*.

With the above arrangement, the lateral edge detection sensor 81 and the lateral edge initial position detection sensor 84 are movable in the direction indicated by the arrow mark D or E, that is, the direction perpendicular to the sheet conveyance direction A by the lateral edge detection means moving motor. As the lateral edge initial position detection sensor 84 is moved in the arrow E direction, a marker 63*b* for the lateral edge initial position, which is a part of the casing 63, is detected by the light receptor portion 84*a*. Further, lateral edge detection sensor 81 can be set at a point correspondent to the selected sheet size, by moving the sensor 81 in the direction of the arrow mark D.

In order to detect the lateral edge of a sheet, after the aforementioned sheet detection sensor 31 detects the leading edge of the sheet, the hole punching means moving motor is activated with predetermined timing to move the hole punching means and the lateral edge detection sensor 81 in the direction of an arrow mark D. Then, as the light receptor portion 81*a* of the lateral edge detection sensor 81 is blocked by the lateral edge of the sheet, the controlling apparatus determines that the hole punching apparatus is at the predetermined location relative to the sheet edge, aligning the position for hole punching means 60 relative to the sheet edge, and thereby, properly aligning hole positions relative to the sheet edge.

Next, the flow of a sheet P will be described.

Figure 5:
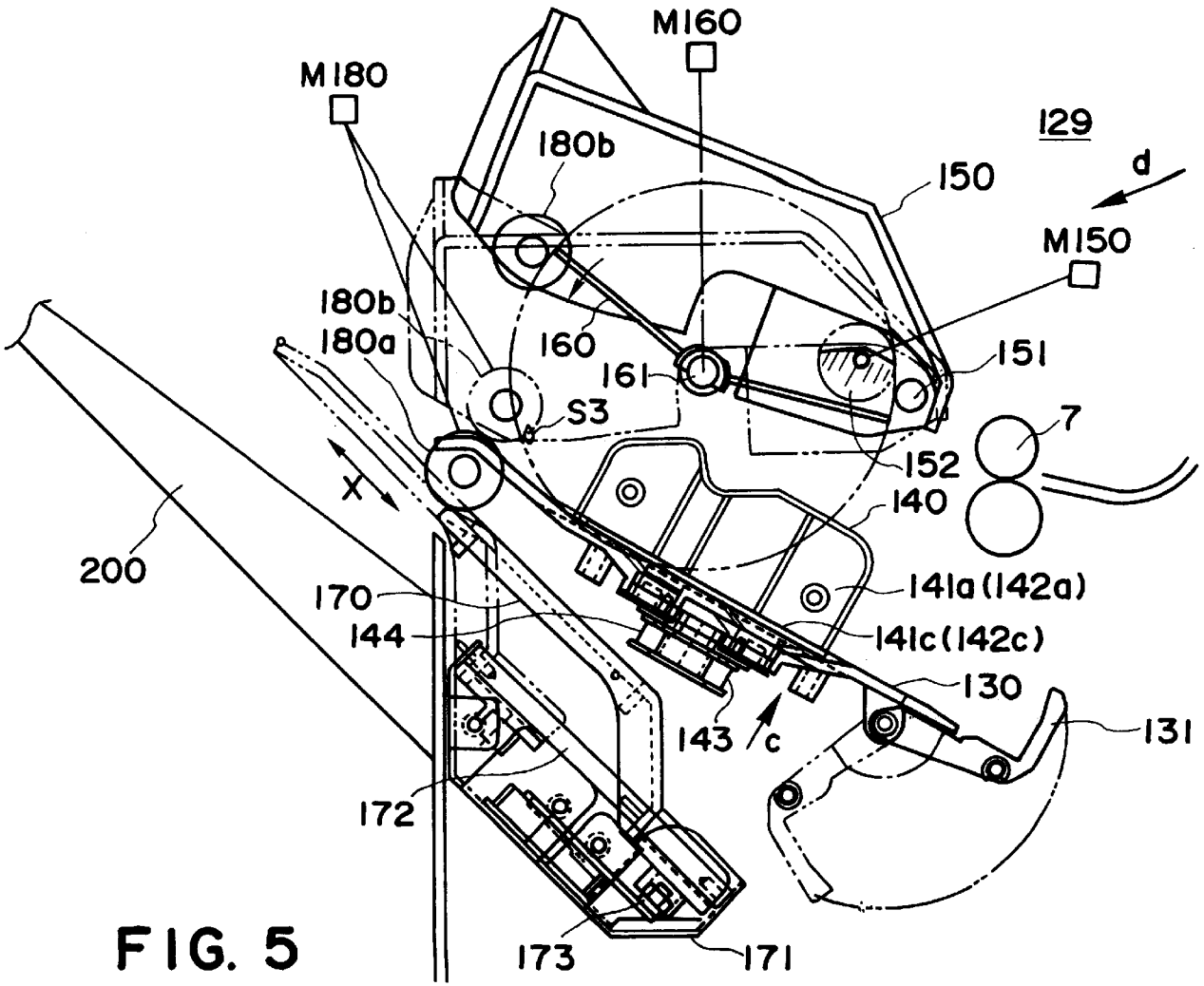
FIG. 5 is a drawing as seen from the front, of the oscillating guide, the processing tray, and their adjacencies, in the apparatus illustrated in FIG. 1.
Figure 6:
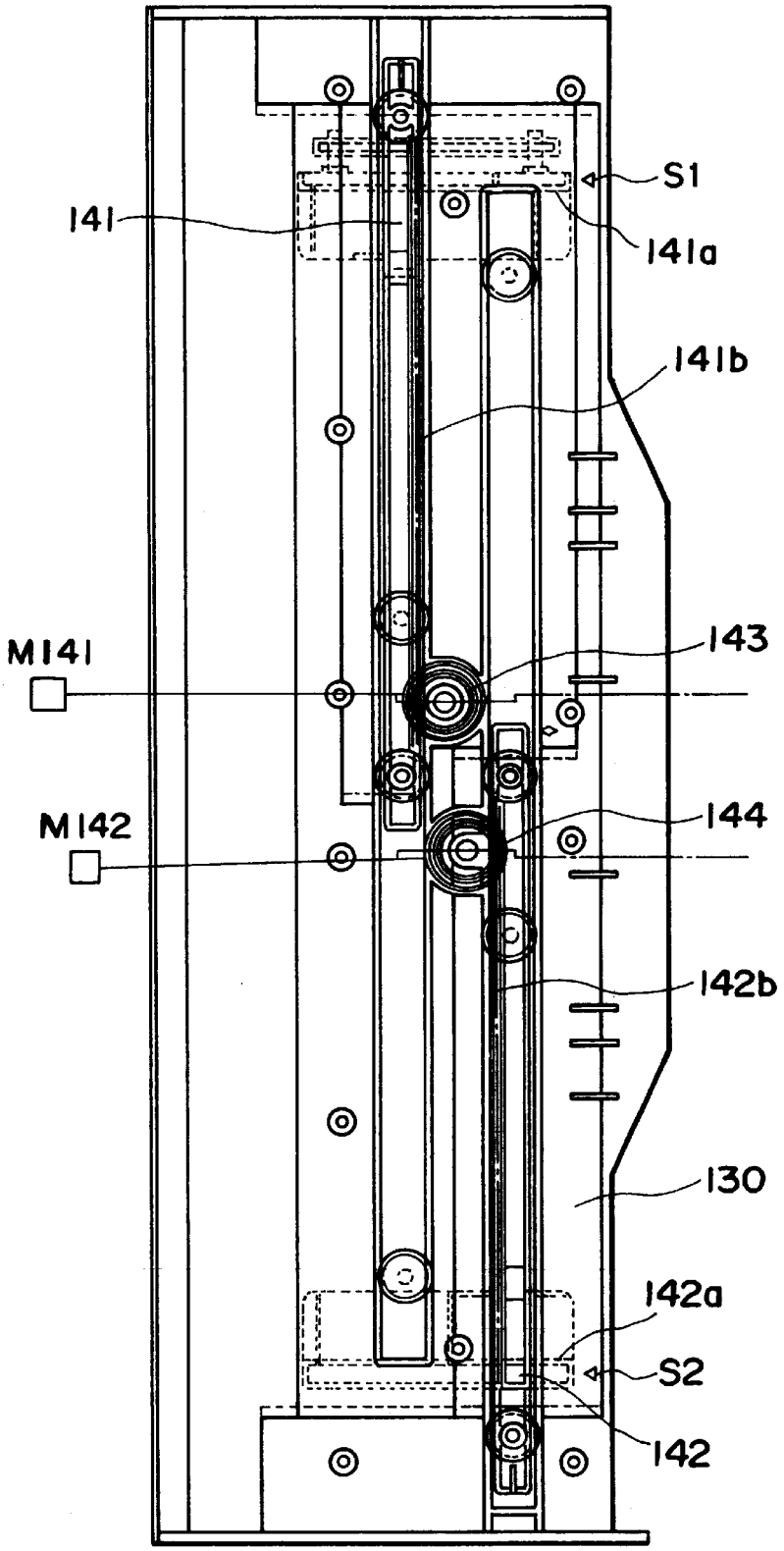
FIG. 6 is a horizontal drawing of the processing tray, the mechanism for moving the aligning wall, and their adjacencies, in the apparatus illustrated in FIG. 1.

Referring to FIG. 5, as a user selects the non-sorting mode through the control panel (unillustrated) of the main assembly of an image forming apparatus, the sheet entrance roller pair 2, conveyer roller 3, and large conveyer roller 5 rotate, conveying the sheet P discharged from the main assembly 300 of an image forming apparatus. Next, a flapper 11 is pivoted by a solenoid (unillustrated) to the position illustrated in the drawing, directing the sheet P into the non-sorting path 21. As the trailing edge of the sheet P is detected by the sensor 33, the roller 9 is rotated at a speed appropriate for stacking the sheet P, to discharge the sheet P into the sampling tray 200.

Next, the operation to be carried out when a user selects the stapling/sorting mode will be described.

Figure 16:
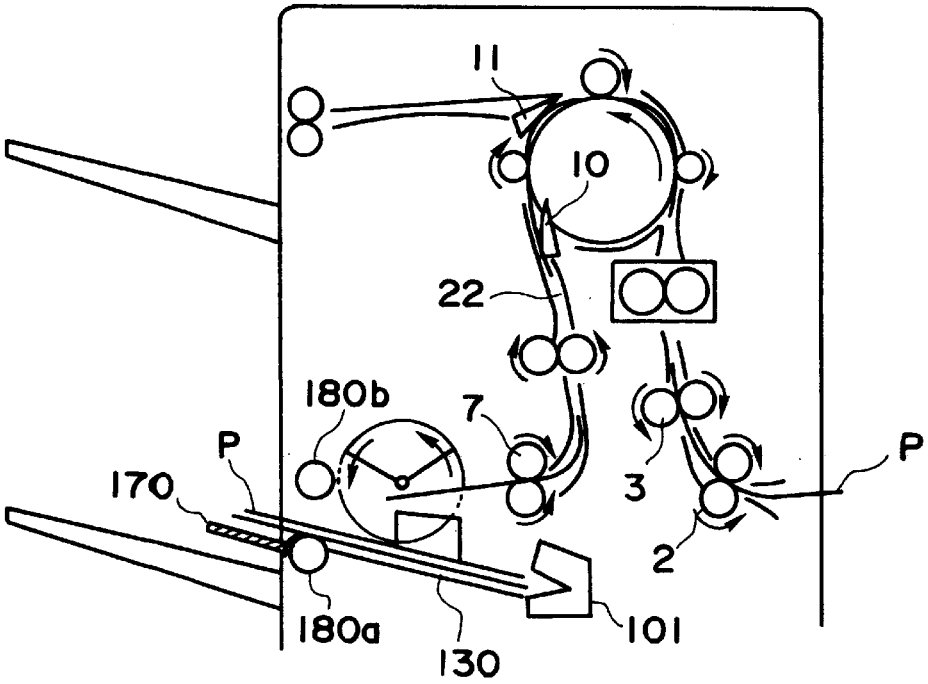
FIG. 16 is also a schematic vertical section of the top portion of the sheet processing apparatus in the first embodiment of the present invention, and depicts the operation of the sheet processing apparatus in a stapling/sorting mode.

Referring to FIG. 16, the sheet entrance roller pair 2, conveyer roller 3, and large conveyer roller 5 rotate to convey the sheet P delivered from the apparatus main assembly 300. The flappers 10 and 11 are positioned as illustrated in the drawing. The sheet P is moved through the sorting path 22, and is delivered to the stapler 101 by the discharge roller pair 7. At this moment, the shuttling tray 170 is out to prevent the leading end portion of the sheet P from hanging from the edge of the sheet processing tray 130, so that the sheet P is not prevented from sliding backward relative to the sheet conveyance direction, and also to aid the sheet P to be aligned.

After being discharged, the sheet P begins to slide toward the trailing end stopper 131 due to its own weight, and at the same time, the sheet paddling member 160, which has been on standby at the home position, starts rotating in the counterclockwise direction by being driven by the motor M160, aiding the movement of the sheet P. As soon as the sheet P stops, with the trailing edge of the sheet P being squarely in contact with the trailing end stopper 131, the rotation of the paddle 160 is stopped. Then, the aligning member aligns the sheet P. The operation for aligning the sheet P will be described later.

Figure 17:
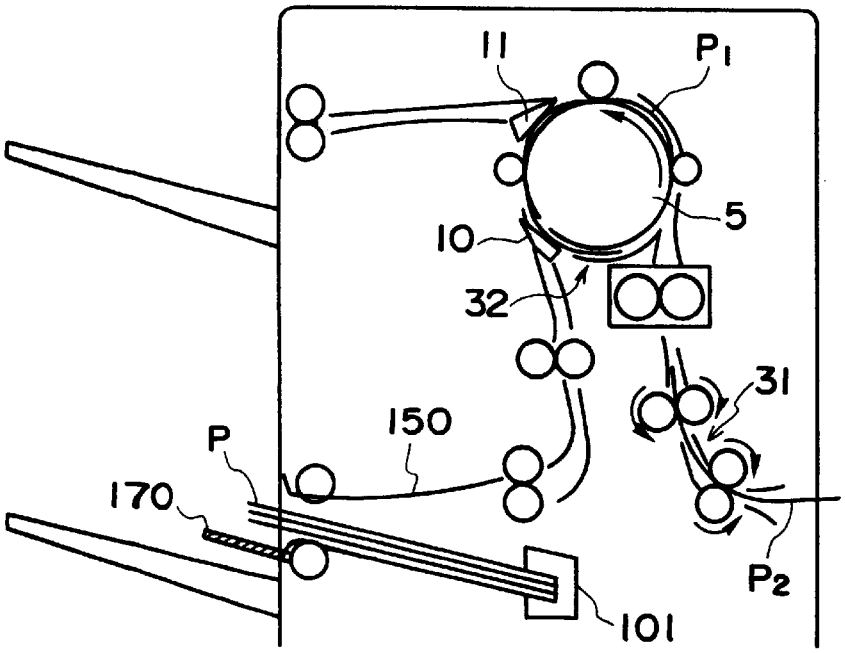
FIG. 17 is also a schematic vertical section of the top portion of the sheet processing apparatus in the first embodiment of the present invention, and depicts the operation of the sheet processing apparatus in a stapling/sorting mode.

After all the sheet P which belong to a given set are discharged into the processing tray 130, and are aligned, the oscillating guide 150 swings down, as illustrated in FIG. 17, causing the roller 180*b* to descend on the stack of sheets in the processing tray 130. Then, the stapler 101 staples the set of sheets.

Figure 18:
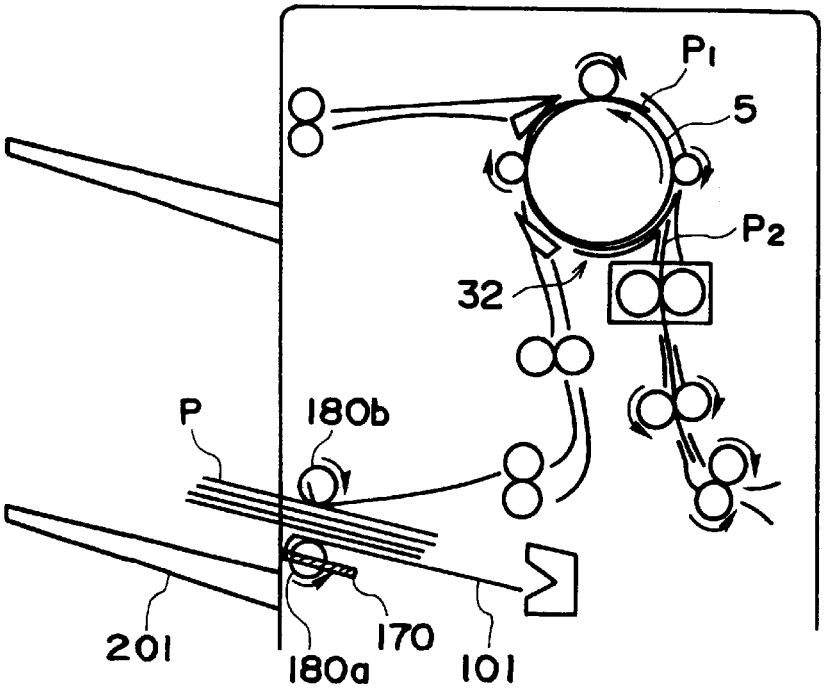
FIG. 18 is also a schematic vertical section of the top portion of the sheet processing apparatus in the first embodiment of the present invention, and depicts the operation of the sheet processing apparatus in a stapling/sorting mode.
Figure 19:
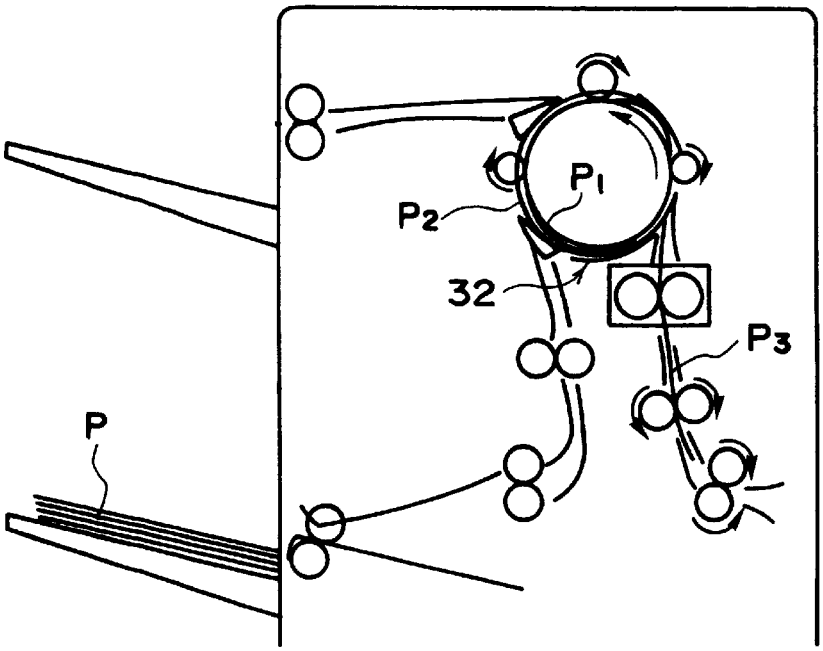
FIG. 19 is also a schematic vertical section of the top portion of the sheet processing apparatus in the first embodiment of the present invention, and depicts the operation of the sheet processing apparatus in a stapling/sorting mode.

Meanwhile, the sheet P1 discharged from the apparatus main assembly 300 is wrapped around the large conveyer roller since the flapper 10 is positioned as illustrate din FIG. 17, and then, the large conveyer roller 5 is stopped after advancing the sheet P a predetermined distance from a sensor 32. Then, after the next sheet P2 is advanced a predetermined distance from a sheet detection sensor 31, the large conveyer roller 5 is restarted. As a result, the first and second sheets P1 and P2 overlap, with the second sheet P2 being ahead of the first sheet P by a predetermined distance as shown in FIG. 18. Next, both sheets P1 and P2 are wrapped, being overlapped, around the large conveyer roller 5 as shown in FIG. 19, and then, the large conveyer roller 5 is stopped after advancing the two sheets P1 and P2 the predetermined distance. Meanwhile, the set of sheets on the processing tray 130 is discharged into the stacking tray 200 as shown in FIG. 19.

Figure 20:
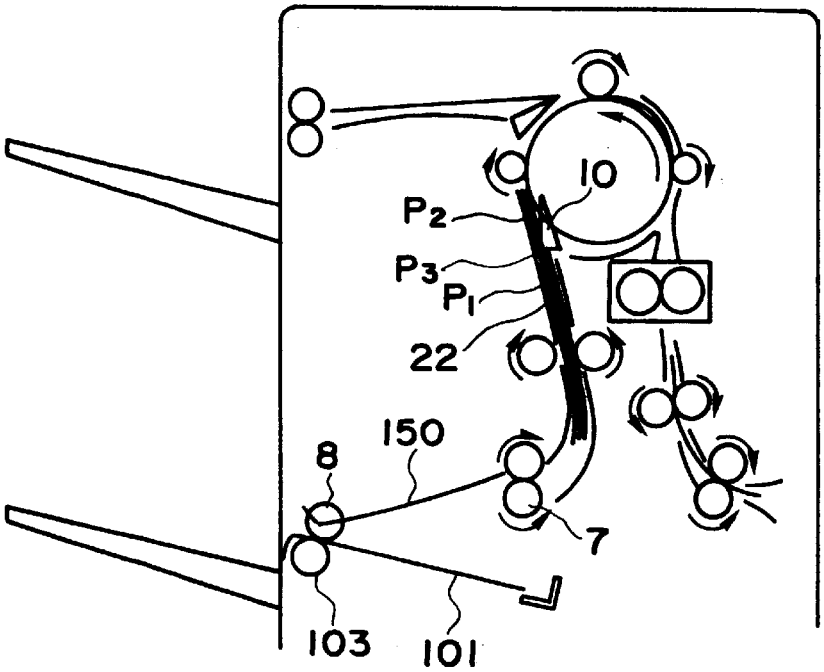
FIG. 20 is also a schematic vertical section of the top portion of the sheet processing apparatus in the first embodiment of the present invention, and depicts the operation of the sheet processing apparatus in a stapling/sorting mode.

As for the shuttling tray 170, before the sheet set completely comes out from between the rollers of the sheet set discharge roller pair 7, the shuttling tray 170 is moved to the home position to allow the set of sheets to freely fall into the stacking tray 200. Next, as the third sheet P3 reaches a predetermined position as illustrated in FIG. 19, the large conveyer roller 5 is restarted, causing the third sheet P to overlap with the preceding two sheets P1 and P2, with the sheet P3 being ahead of the sheet P2 by the predetermined distance as illustrated in FIG. 20. Then, the flapper 10 is pivoted to guide the three sheets P1, P2, and P3 into the sorting path 22.

Figure 21:
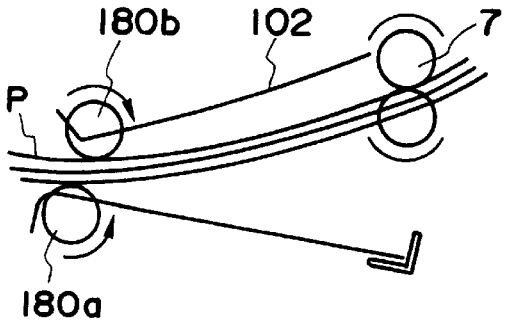
FIG. 21 is a schematic vertical section of the processing tray and the adjacencies thereof, and depicts the operation of the sheet processing apparatus in a stapling/sorting mode.
Figure 22:
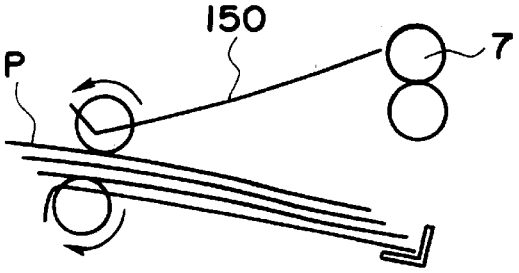
FIG. 22 is also a schematic vertical section of the processing tray and the adjacencies thereof, and depicts the operation of the sheet processing apparatus in a stapling/sorting mode.
Figure 23:
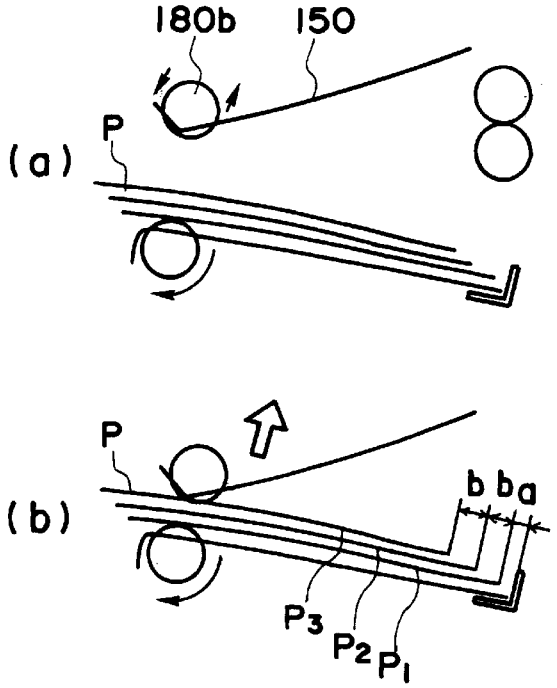
FIG. 23 is also a schematic vertical section of the processing tray and the adjacencies thereof, and depicts the operation of the sheet processing apparatus in a stapling/sorting mode.

At this time, the oscillating guide 150 remains at the bottom position, or the closed position, so that the leading ends of the three sheets P are pinched between the rollers 180*a* and 180*b* as shown in FIG. 21. Then, as soon as the trialing edges of the three sheets P pass the roller pair 7, the rollers 180*a* and 180*b* are rotated in reverse to aid the three sheets P to move backward. But, before the trialing edge of the first sheet P1 comes in contact with the trailing end stopper 131, the oscillating guide 150 is raised, hence the roller 180*b* is raised, being thereby separated from the sheet P. The fourth sheet and the sheets thereafter are also conveyed through the sorting path 22 in the same manner as the first to third sheets which belong to the first set are conveyed, and then are discharged into the processing tray. The third set of sheets, and the sets of sheets thereafter are also conveyed and stacked in the stacking tray 200 in the same manner as the first and second sets of sheets until a selected number of sets of sheets are stacked in the stacking tray 200.

When a plurality of sheets P are conveyed in layers as described above, each sheet is set slightly ahead of the sheet immediately below, relative to the sheet conveyance direction; the sheet P2 is set slightly downstream of the sheet P1, and the sheet P3 is set slightly downstream of the sheet P2, relative to the sheet conveyance direction.

The amount of deviation between two adjacent sheets and the timing with which the oscillating guide 150 begins to be raised are related to the time necessary for each set of sheets to be properly placed in the processing tray 130. In other words, it is related to the speed at which a set of sheets is moved backward toward the trailing end stopper 131 by the rollers 180*a* and 180*b*, and the processing capacity of the apparatus main assembly 300. In this embodiment, in which the sheet conveyance speed is 750 mm/sec; the amount of deviation (b) between two adjacent sheets is approximately 20 mm; and the speed at which a set of sheets is moved backward by the rollers 180*a* and 180*b* is 500 mm/sec, the timing for raising the roller 180*b* is set so that the roller 180*b* is raised when the sheet P1 arrives at a point which is 40 mm (value of a) away from the trailing end stopper 131.

Next, the sorting mode will be described.

Figure 24:
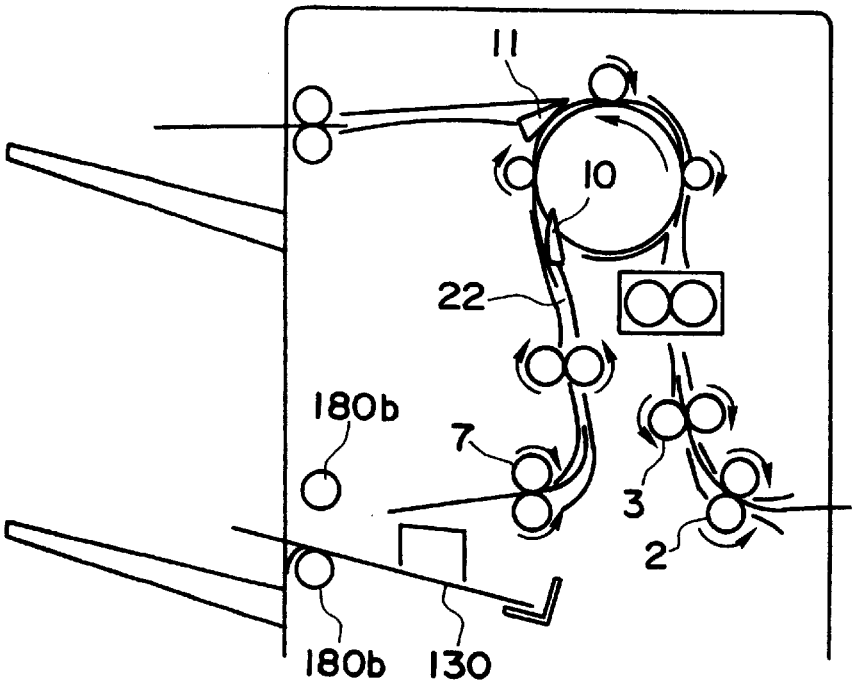
FIG. 24 is a schematic vertical section of the top portion of the sheet processing apparatus in the first embodiment of the present invention, and depicts the operation of the sheet processing apparatus in a sorting mode.
Figure 25:
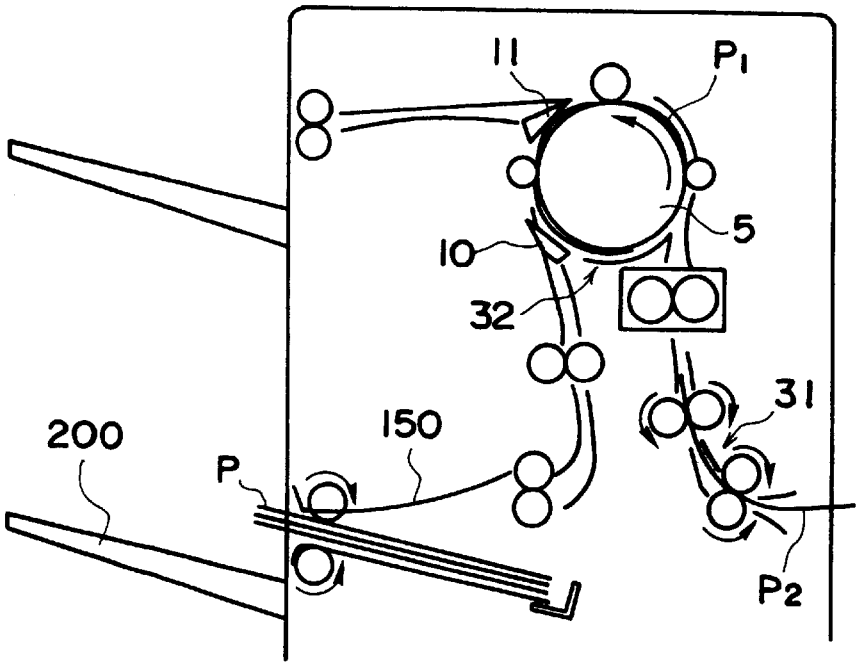
FIG. 25 is also a schematic vertical section of the top portion of the sheet processing apparatus in the first embodiment of the present invention, and depicts the operation of the sheet processing apparatus in a sorting mode.

A user is to select the sorting mode on an unillustrated control panel after placing an original on the RDF500, and to press the start button (unillustrated). Then, the entrance roller pair 2, and conveyer roller 3 are rotated in the directions illustrated in FIG. 24, that is, in the same manner as they are in the stapling/sorting mode, and stack sheets in the processing tray 130. Then, the sheets are aligned by the aligning means 140. After a relatively small number of sheets is stacked in alignment on the processing tray 130, the oscillating guide 150 swings down as shown in FIG. 25, and the rollers 180*b* and 180*a* convey the small number of the aligned and stacked sheets all together.

The next sheets P are guided into the sheet path above the flapper 10, and are wrapped around the large conveyer roller 5 as sheets are in the stapling mode. Then, these sheets P are discharged into the processing tray 130 after the preceding group of sheets in the processing tray 130 is discharged from the processing tray 130. According to the tests conducted by the inventors, the number of sheets to be discharged together as a group of sheets is desired to be no more than 20. Further, the number of sheets to be discharged as a group of sheets is desired to satisfy the following requirement:

Number of sheets in a set of originals≧Number of sheets to be discharged together as a group of sheets≦20. The number of sheets in a set of originals means the number of sheets of a set of originals placed in an apparatus, for example, an image forming apparatus, which discharges into a sheet processing apparatus, sheets on which an image has been formed. In other words, it is the same as the number of sheets in one set of sheets.

Therefore, when producing a program, if the number of sheets to be discharged together as a group of sheets is set at five, but the number of sheets in a set of originals is four, the sheets are discharged in a group of four. If the number of sheets in a set of originals is five or more, for example, 14, the sheets are aligned and discharged in two groups of five sheets, and one group of four sheets.

In other words, when the number of sheets in a set of sheets to be discharged into the processing tray 130 is no less than a predetermined number (20 or more), the sheets to be discharged are handled in a sub-set. More specifically, they are discharged into the processing tray 130 until the number of the sheets discharged into the processing tray 130 reaches a predetermined number, which is in the number of sheets in a sub-set, and is no less than two, for example, five, and then, as soon as this predetermined number is reached, the sheets in the processing tray 130 are discharged into the stacking tray 200 by the sheet set discharge rollers 180*a* and 180*b*.

After all the sheets which belong to the first set are discharged, an aligning wall 141 on the front side is moved with an aligning wall 142 on the rear side so that the location of the aligned edges of the sheets in the second set becomes slightly off from that of the first set. More specifically, when two or more sets of sheets are discharged into the stacking tray 200, after a predetermined number of sheets which constitute a set are accumulated in the processing tray 130, they are shifted to a location which is slightly off from the location where the immediately preceding set is before being discharged after being aligned. Then, they are discharged into the stacking tray 200 from the processing tray 130, from the location which is slightly off from where the immediately preceding set is. As a result, as the two or more sets of sheets are stacked into the stacking tray 200, they are staggered, that is, located alternately between the first and second positions, which will be described later in detail.

Figure 26:
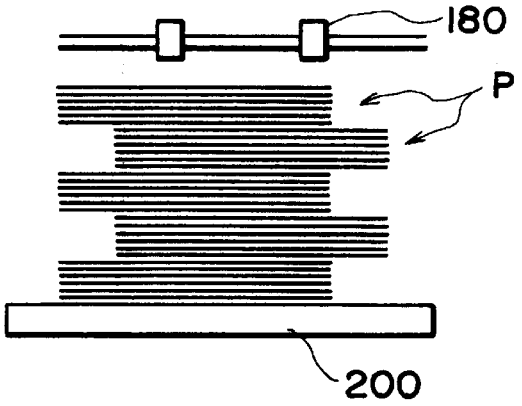
FIG. 26 is a side view of the stacked sets of sheets in a sorting mode.

Thus, the sheets which belong to the second set are also discharged into the processing tray 130 in two or more sub-sets, shifted to a location slightly off from the location at which the sheets belonging to the first set are aligned, are aligned there, and then, are discharged into the stacking tray 200. After all the sheets in the second set are processed, the front and rear aligning walls 141 and 142, respectively, are returned to their original locations at which they align the sheets belonging to the first set, being readied for aligning the sheets which belong to the third set. The above sequence is repeated until all sets of sheets are stacked in a staggered arrangement in the stacking tray 200 as illustrated in FIG. 26.

As described, according to the present invention, when two or more sets of sheets are to be stacked in the stacking tray 200, and the number of sheets in each set exceeds a predetermined number, the sheets in each set are discharged into the processing tray 130 in a sub-set, or a group having a smaller number of sheets than each set, are aligned, and then, are discharged into the stacking tray 200. Then, after all the sheets belonging to each set are discharged into the processing tray 130, the location at which sheets are accumulated and aligned the processing tray 130 is shifted from the location at which the sheets belonging to the immediately preceding set are accumulated and aligned. Therefore, a sheet processing apparatus is much improved in terms of the way two or more sets of sheets are stacked in the stacking tray 200, and also in terms of sheet alignment in each set of sheets.

Next, the sheet aligning operation will be described.

Figure 27:
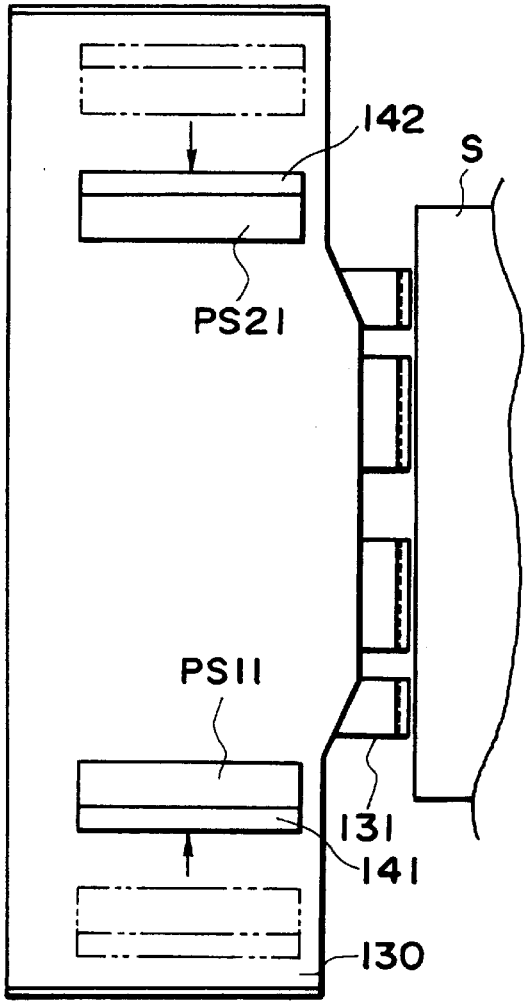
FIG. 27 is a top view of the processing tray in the first embodiment of the present invention, and depicts the sheet aligning operation of the processing tray.

First, when there is not a single sheet in the processing tray 130, in other words, when the first of the sheets P (for example, three sheets) in a set of sheets is discharged into the processing tray 130, the front and rear aligning members 141 and 142, which are on standby at their home positions, are shifted to positions PS11 and PS21, respectively, which are slightly off from where the lateral edges of the first sheet P will be after being aligned (FIG. 27).

Figure 28:
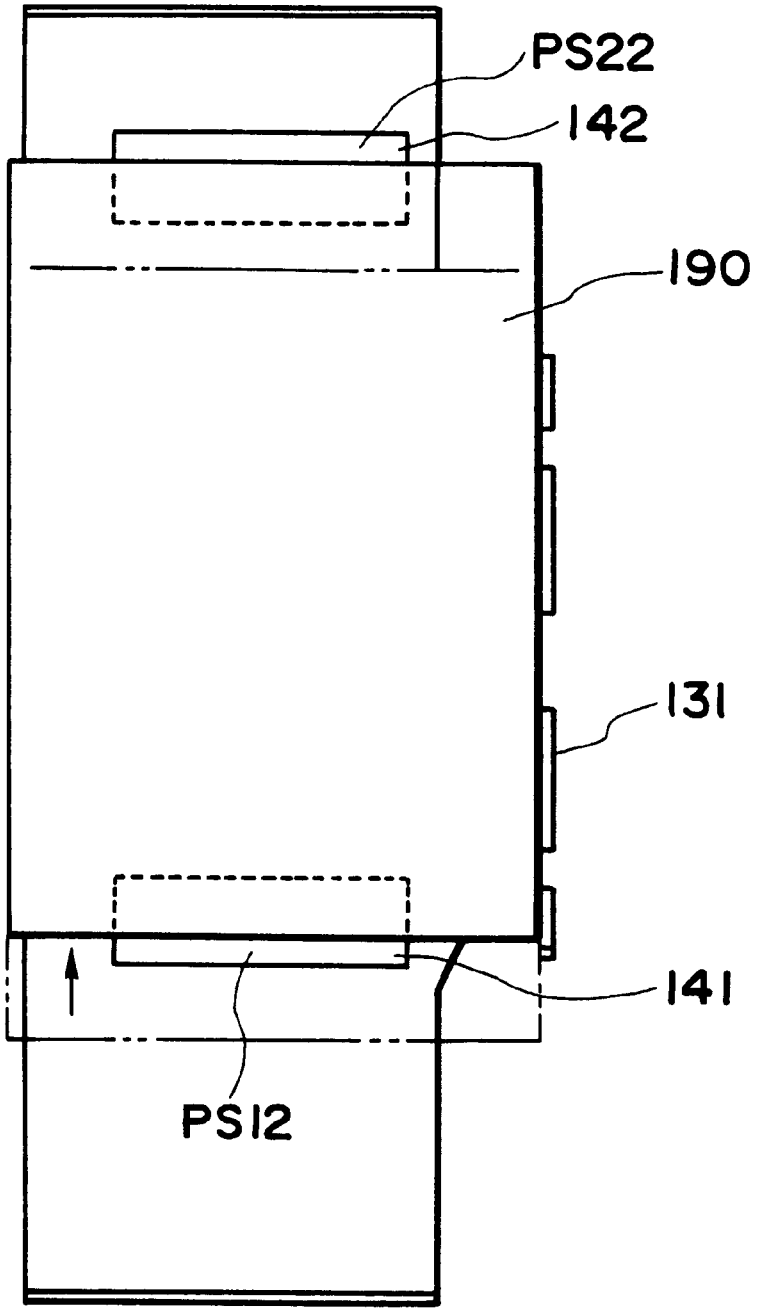
FIG. 28 is also a top view of the processing tray in the first embodiment of the present invention, and depicts the sheet aligning operation of the processing apparatus.

Then, as described before, as the trialing edge of the third sheet comes in contact with the trailing end stopper 131, with its bottom surface being in contact with the sheet supporting surfaces 141*c* and 142*c* of the aligning members, the aligning members 141 and 142 are moved to the aligning positions PS12 and PS22, respectively, aligning the sheets into a predetermined boundary, or the first sheet alignment boundary 190 (FIG. 28). Next, the aligning member 141 is moved to the position PS11, and kept there on standby for the next sheet. Then, as soon as the discharging of the next sheet is completed, the aligning member 141 is moved to the aligning position PS12, aligning the sheet into the first sheet alignment boundary 190.

Figure 29:
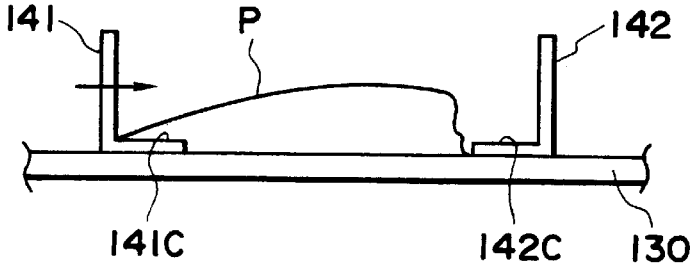
FIG. 29 is a front view of the processing tray in the first embodiment of the present invention, and also depicts the sheet aligning operation of the processing apparatus.

During the above movement of the front aligning member 141, the rear aligning member 142 remains at the aligning position PS22, playing the role of a referential member, whereas the front aligning member 141 continues to shuttle between the standby position P11 and the aligning position P12 until the aligning of the last sheet in the currently processed set is completed. With the aligning operation described above, it does not occur that a sheet collides with the inward edges of the sheet supporting portions of the aligning members, and buckles at the colliding edge like a sheet P is buckling at the edge after colliding with the edge of the sheet supporting portions 142*c* of the aligning member 142, as illustrated in FIG. 29.

After the completion of the aligning, the first set of sheets is stapled if required, and then is discharged into the stacking tray 200, as described before.

Figure 30:
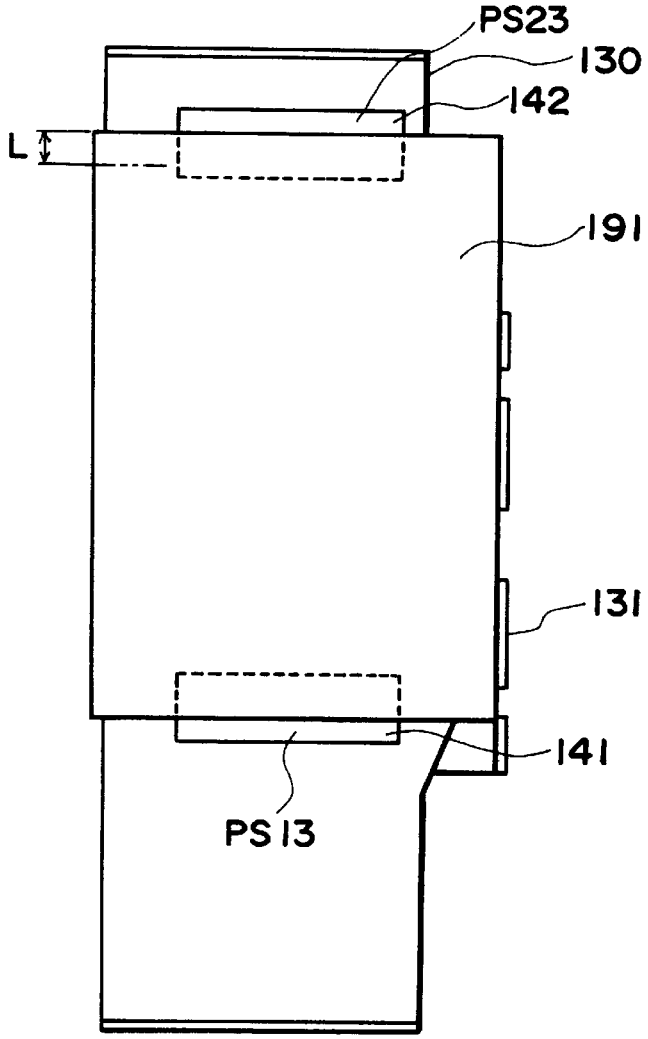
FIG. 30 is a top view of the processing tray in the first embodiment of the present invention, and depicts the sheet aligning operation of the processing apparatus.

Next, the sheets, for example, three sheets, which constitute the second set, are discharged into the processing tray 130. During the discharging of these sheets into the processing tray 130, the aligning members 141 and 142 remain on standby at the positions PS11 and PS12 as they do for the sheets of the first set (FIG. 27), but the sheet alignment boundary, or the boundary into which the sheets converge as they are aligned, is moved to the second sheet alignment boundary 191, which is rearward of the first sheet alignment boundary by a predetermined margin (FIG. 30). For the third set, the sheet alignment boundary is returned to the first position 190; for the fourth set, to the second position; and so on. In other words, according to the present invention, the sheet alignment boundary is alternated for each set between the first and second positions 190 and 192. As a result, when two or more sets of sheets are to be processed, they can be stacked in a staggered arrangement in the stacking tray 200, by a deviation of L.

The amount L of the deviation may be varied between L1 and L2, depending on whether the apparatus is in the sorting mode or the stapling mode. For example, in this embodiment, when in the stapling mode, the amount L is set at approximately 15 mm (L1) since all that is necessary is to prevent the staples of the adjacent two sets of sheets from overlapping, whereas when in the sorting mode in which it should be easy to visually discriminate each set from others, the amount L of the deviation is set at approximately 20–30 mm (L2). In other words, the distance the aligning members 141 and 142 are moved in the stapling mode is reduced to improve the processing speed.

In the stapling mode, the stapler 101 is on standby at a position correspondent to the points of a sheet where a staple goes in, and staples the sheets in the processing tray 130 after the aligning of the last sheet in each set is completed. Further, as the sheet alignment boundary is moved between the two positions which are apart by an amount equivalent to the predetermined amount L of the deviation between the adjacent two sheets, the stapler 101 is also moved accordingly.

As for the structure for moving the stapler 101 along the edges of sheets, or changing the angle of the stapler 101, in response to the selected stapling mode (angled single front stapling, angled single rear stapling, dual central stapling, or the like), it is the same as described before. However, this structure has a limit in terms of the range in which the stapler 101 is allowed to maintaining the same stapling posture (parallel or slanted relative to the sheet edge). In addition, there are so many variations in sheet size. Therefore, if there is only one pair of sheet alignment boundaries for all of the stapling modes, there occur situations in which stapling is impossible. Thus, the locations for the first and second aligning positions for the aligning members 141 and 142 may be changed depending on the type of the stapling mode.

Figure 31:
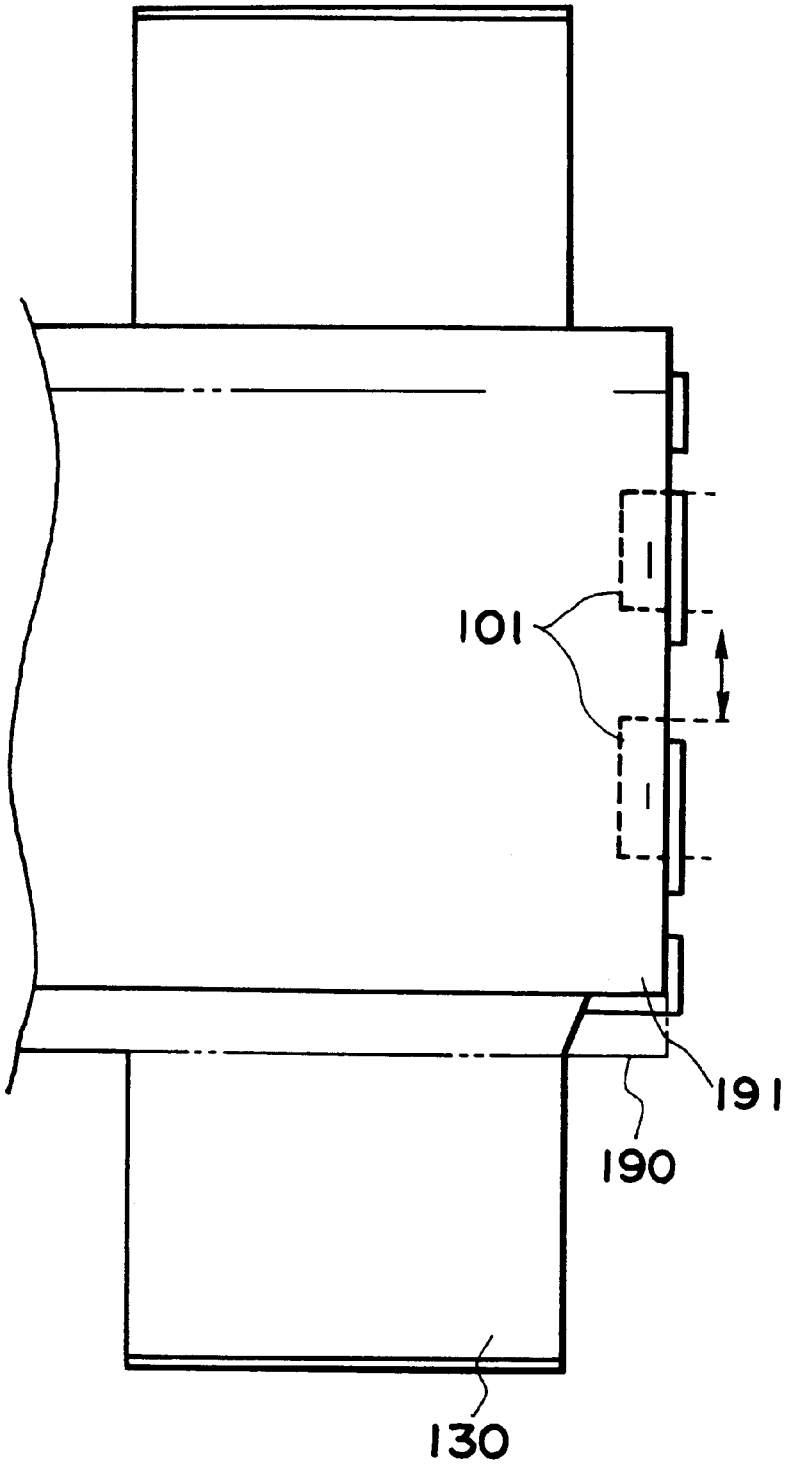
FIG. 31 is also a top view of the processing tray in the first embodiment of the present invention, and depicts the sheet aligning operation of the processing apparatus.
Figure 32:
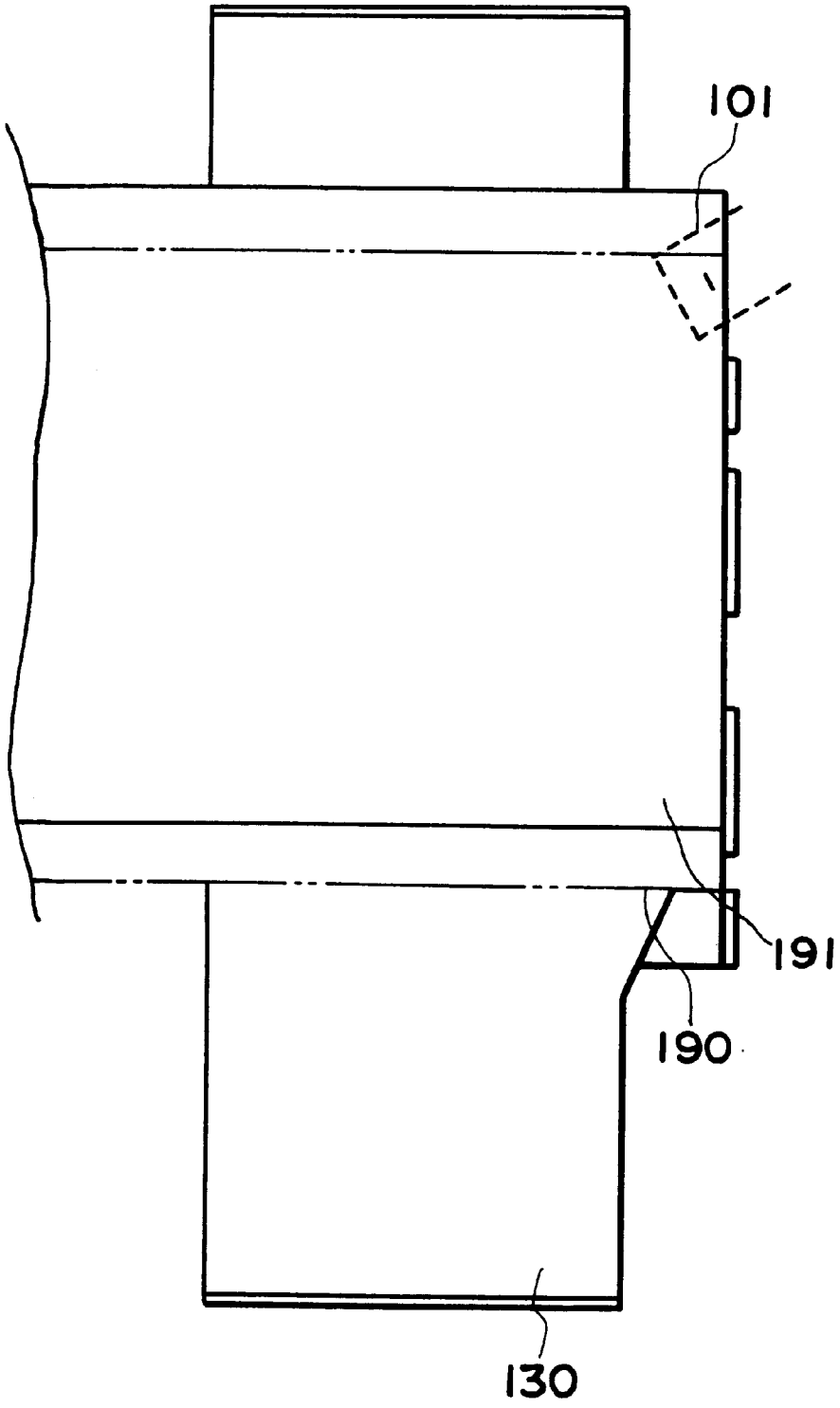
FIG. 32 is also a top view of the processing tray in the first embodiment of the present invention, and depicts the sheet aligning operation of the processing apparatus.
Figure 33:
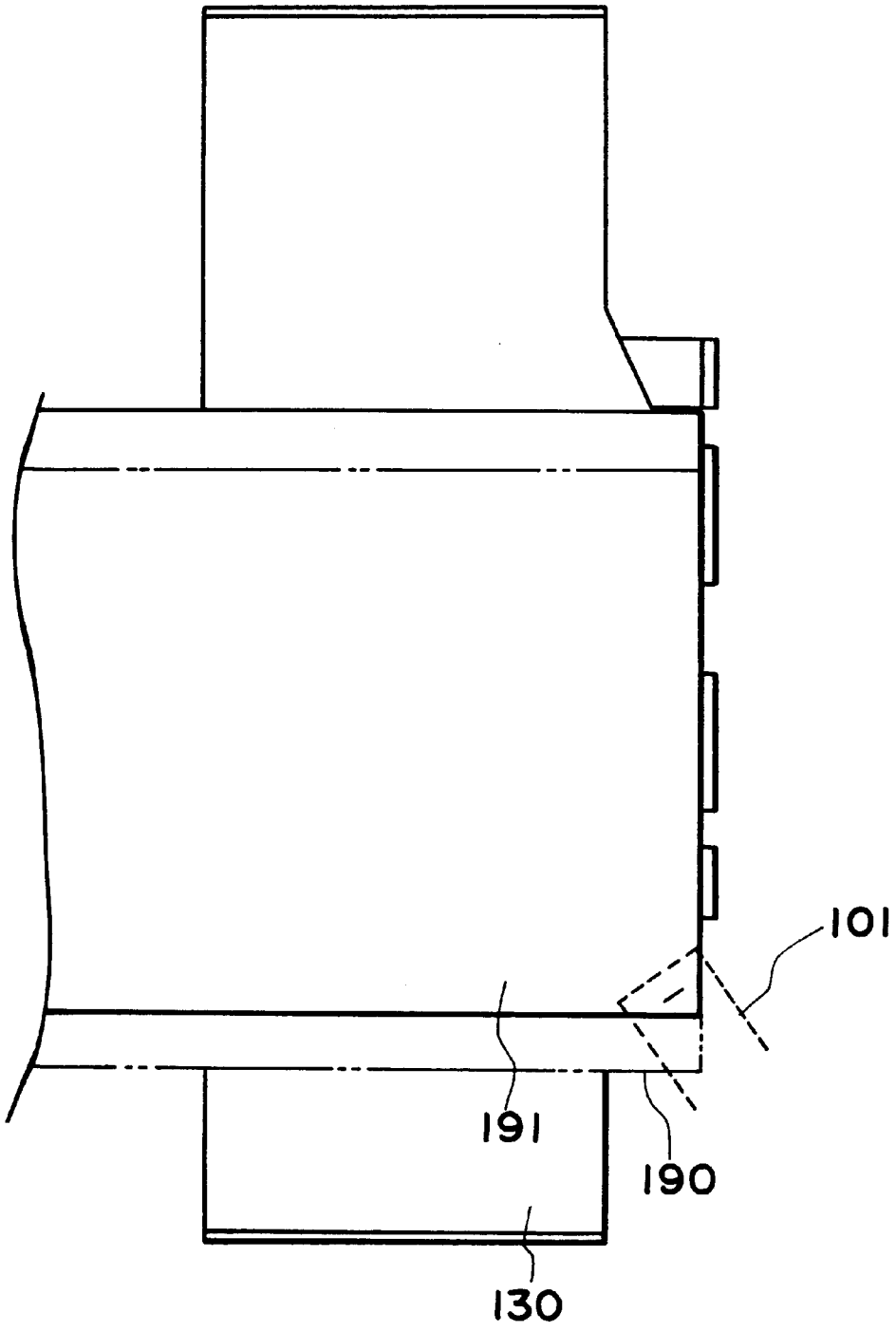
FIG. 33 is also a top view of the processing tray in the first embodiment of the present invention, and depicts the sheet aligning operation of the processing apparatus.

FIG. 31 depicts the sheet alignment boundary in the two point stapling mode, and FIG. 32 depicts the sheet alignment boundary in the angled rear stapling mode. FIG. 33 depicts the sheet alignment boundary in the angled front stapling mode. In the drawings, the double dot chain line outlines the first sheet alignment boundary, and the solid line outlines the second sheet alignment boundary. When the sheet alignment boundary is on the front side relative to where discharged sheets land in the processing tray 130, the rear aligning member 142 shifts the sheets toward the front aligning member 141 which serves as the alignment reference, and when the sheet alignment boundary is on the rear side relative to where the sheets land in the processing tray 130, the sheets are aligned in the manner described before.

By varying the sheet alignment boundary depending on the stapling mode as described above, sheets can be moved to a location where the sheets can be properly stapled by the stapler 101.

As is evident from the above description, according to the present invention, the sheet alignment boundary, into which the sheets discharged into the processing tray 130 by the discharge roller pair 7 are converged by the aligning members 141 and 142, is switched for each set between two locations. Therefore, when two or more sets of sheets are processed, they are stacked in a staggered arrangement in the stacking tray 200 as they are discharged from the processing tray 130 into the stacking tray 200, eliminating the need for shifting the stacking tray 200 to stagger the sheet sets. In other words, it is unnecessary to shift the stacking tray 200 in order to cause an incoming set of sheets to stagger relative to the immediately preceding set as it is discharged into the stacking tray 200. Thus, damages such as scratches or buckling which are liable to occur to sheet edges due to the friction which occurs when the stacking tray 200 is shifted in the alternate directions while holding a large number of sheets do not occur; the quality of the discharged sheets can be maintained.

Further, a motor and a mechanism for shifting the stacking tray 200 with large capacity is unnecessary, and therefore, the apparatus size can be reduced.

Next, the movements of the stacking tray 200 and the sampling tray 201 will be described with reference to FIGS. 8 and 9. Normally, before activation, each tray remains on standby at a point next to the sheet surface detection sensor correspondent to each tray.

As described before, the normal tray in which copies or the output of a printer are stacked is the stacking tray 200. It receives the copies or the output after they are processed by a processing device such as the aforementioned stapler 101. Also, it receives such sheets that are discharged in the form of an unbound set which is constituted of a relatively small number of sheets. The maximum capacity of the stacking tray 200 is the weight equivalent to 2,000 ordinary sheets, and whether or not the current weight of the sheets in the tacking tray 200 is at the limit of the stacking tray 200 is monitored through the sensor S203*d*.

If a single image forming job does not end even though the stacking tray 200 is already at a position next to the sensor S203*d*, the stacking tray 200 is lowered a distance equivalent to the weight of 1,000 ordinary sheets, that is, to a position next to the sensor S203*d*'. Then, the sampling tray 201 is lowered to the position next to the sheet surface sensor S205 for the processing tray 130, and sheet reception is restarted, this time, into the sampling tray 201. At this time, the sampling tray 201 can take a maximum weight equivalent to 1,000 ordinary sheets, and whether or not the current weight of the sheets in the sampling tray 201 is at the limit of the sampling tray 201 is monitored through the sensor S203*c*.

There are times when the second job is started without removing the sheets on the stacking tray 200 after the first job, the output of which is no more than 2,000 ordinary sheets in terms of weight, or when a current job must be interrupted to perform another job. At such times, the output may be discharged into the sampling tray 201 through the non-sorting path, although the output cannot be processed.

As for the normal modes in which the output from the apparatus main assembly is discharged into the sampling tray 201 through the non-sorting path 21, there are a mode in which a single set of sheets are discharged as a sample, a functional sorting mode in which the sampling tray 201 is designated as the output tray, and the like modes.

Figure 34:
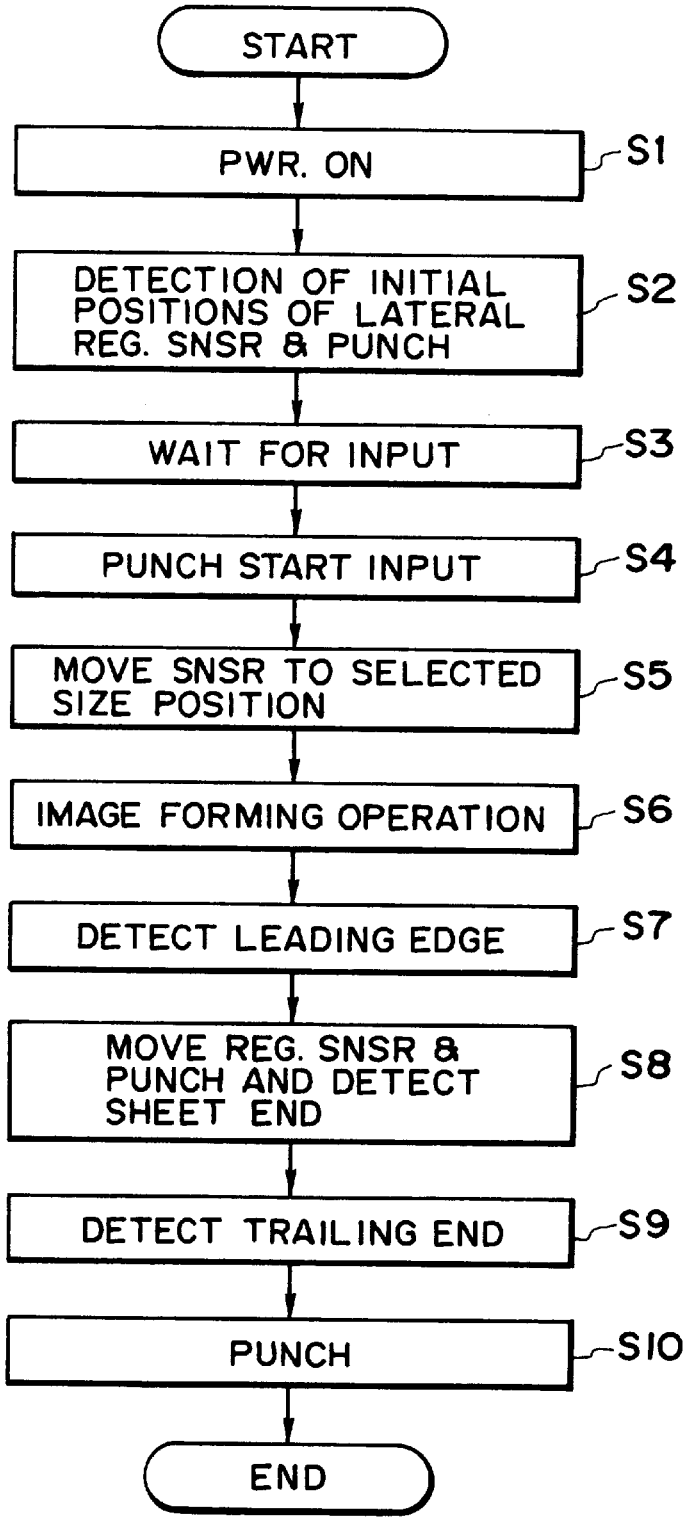
FIG. 34 is an operational flow chart of the processing apparatus in the first embodiment of the present invention, in a hole punching mode.

Next, the hole punching mode will be described following the flow chart given in FIG. 34, concentrating on the operational sequence of the hole punching unit 50.

Figure 13:
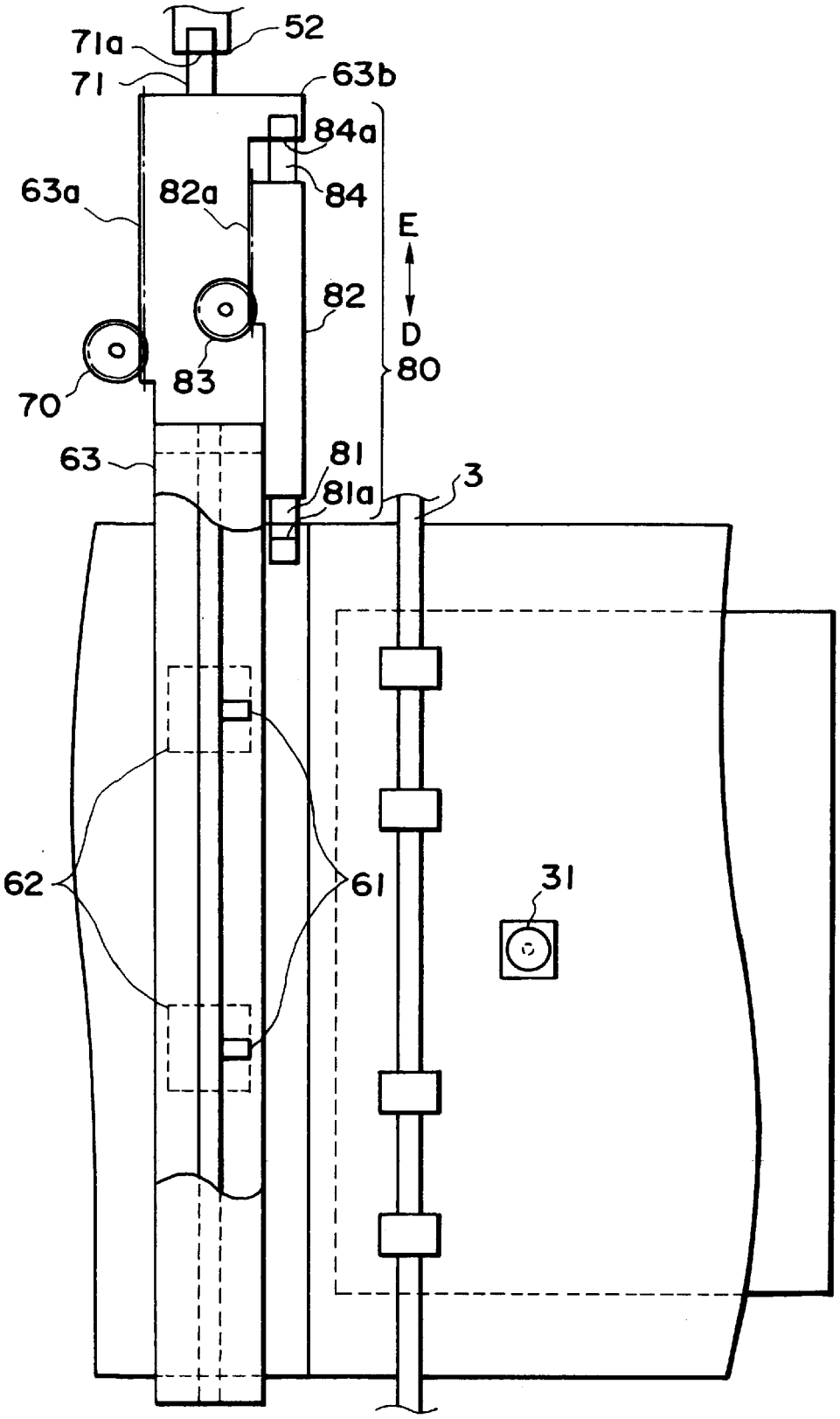
FIG. 13 is a top view of the mechanism for moving the sheet edge registration sensor, of the punching unit in the apparatus illustrated in FIG. 1.
Figure 14:
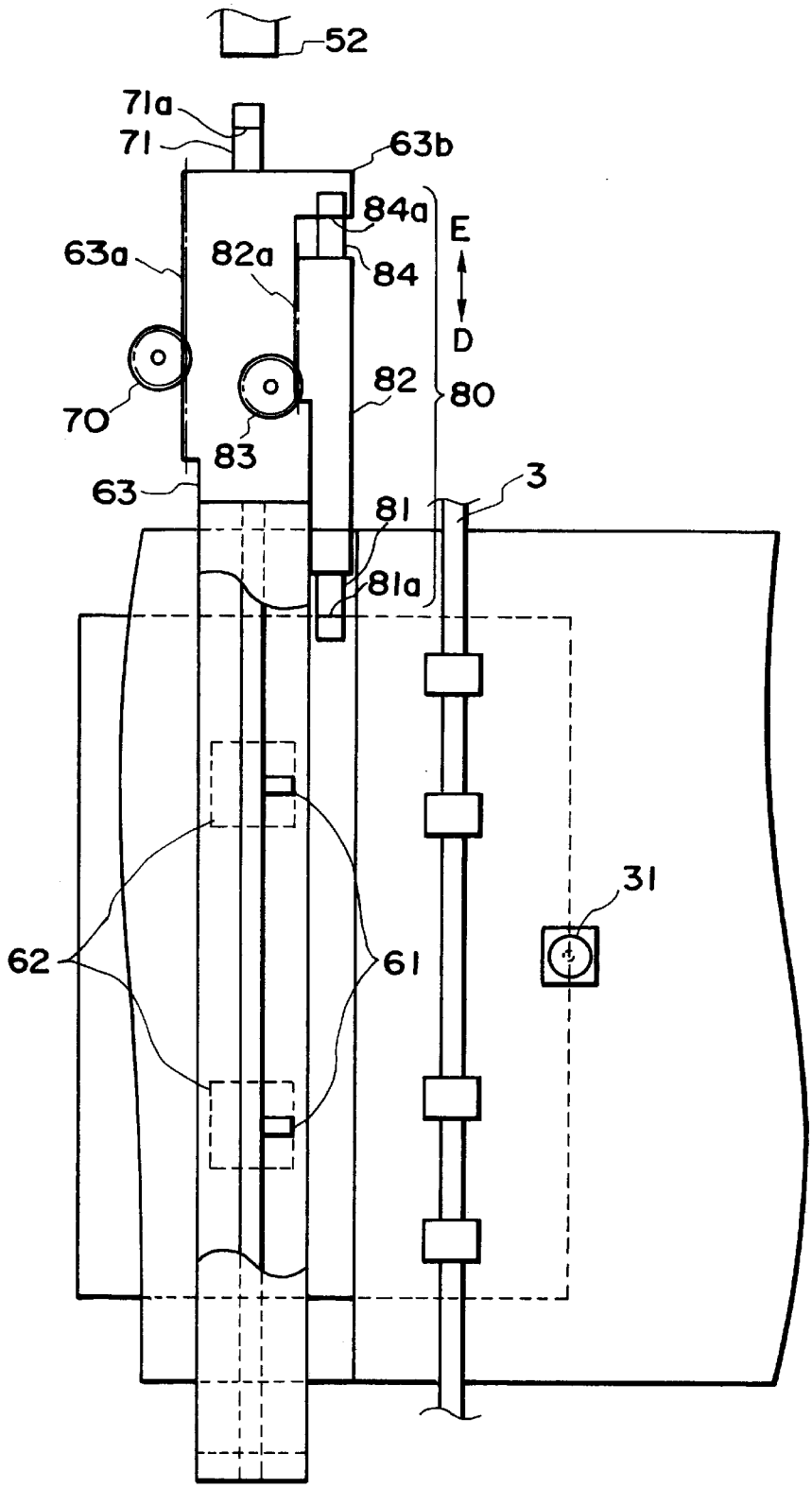
FIG. 14 is also a top view of the mechanism for moving the sheet edge registration sensor, of the punching unit in the apparatus illustrated in FIG. 1.
Figure 15:
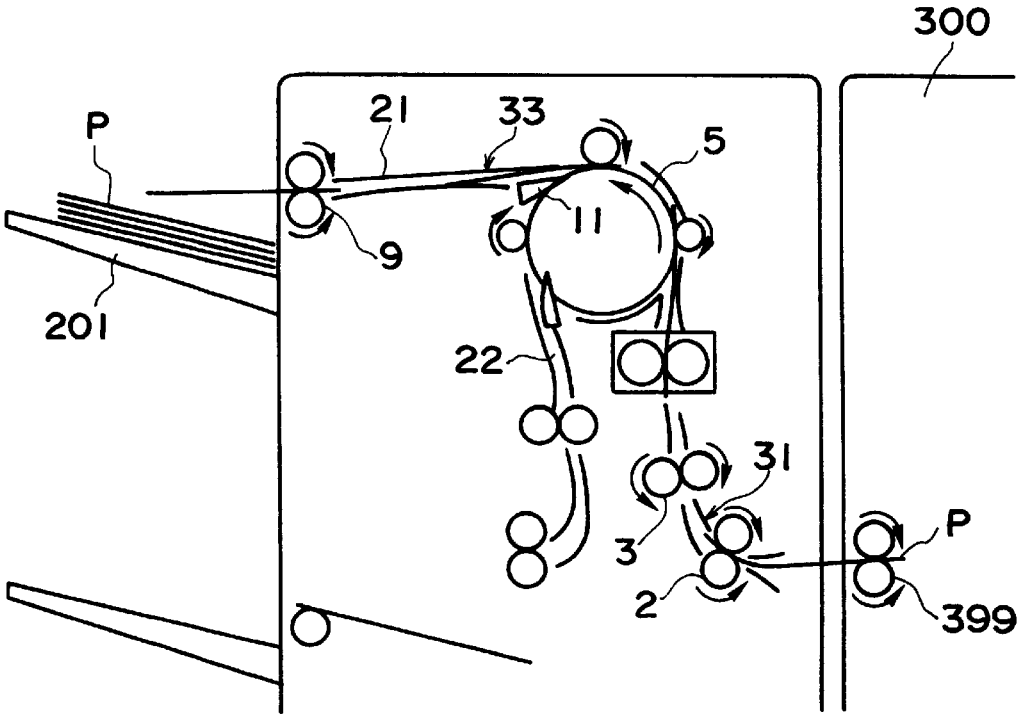
FIG. 15 is a schematic vertical section of the top portion of the sheet processing apparatus in the first embodiment of the present invention, and depicts the operation of the sheet processing apparatus in a non-sorting mode.

As the power source of the apparatus is turned on (S1), the hole punching means moving motor is activated, and moves the hole punching means 60 in the direction of an arrow mark E in FIG. 13. As a result, the light receptor portion 71*a* of the hole punching means initial position detection sensor 71 is blocked by the hole punching means initial position marker 52, in other words, the initial position of the hole punching means 60 is detected, and the hole punching means is stopped.

At the same time, the lateral edge detection means moving motor is also activated to move the sensor arm 82 in the arrow E direction. As a result, the light receptor portion 84*a* of the lateral edge detection sensor 84 is blocked by the lateral edge initial position marker 63*b* provided on the casing 63, in other words, the initial position for the hole punching means 60 is detected (S3), and the hole punching means 60 remains on standby at the initial position to wait for an input (S3).

Next, an operator is to press an unillustrated hole punching mode selection button, and press an unillustrated start button (S4). Then, sheets begin to be conveyed, and image formation begins in the main assembly of the image forming apparatus (S6).

As the same time, the lateral edge detection means moving motor is activated, moving the sensor arm 82 in the arrow D direction until the lateral edge detection sensor 81 arrives at a position correspondent to the selected sheet size (S5).

Then, a sheet with a finished image is conveyed into the finisher 1. As the leading edge of the sheet passes by the sheet detection sensor 31, it is detected by the sheet detection sensor 31, and after a predetermined delay, the hole punching means moving motor is activated, moving the hole punching means 60 and the lateral edge detection sensor 81 in the arrow D direction until the light receptor portion 81*a* of the lateral edge detection sensor 81 is blocked by the lateral edge of the sheet. As the receptor portion 81*a* is blocked by the sheet edge, the motor is deactivated (S8).

Next, as the trialing edge of the sheet passes by the sheet detection sensor 31, it is detected by the sheet detection sensor 31 (S9), and after a predetermined delay, the hole punching mean driving motor 66 is activated, rotating the punch 61 and the die 62 in the arrows B and C directions, respectively. Then, as the punch 61 engages in the hole 62*a* of the die 62, a hole is punched in the sheet, which is being conveyed through the hole punching means 60 (S10). Thereafter, the sheet is delivered to the path correspondent to the sheet processing mode selected from a list of sheet processing modes such as those mentioned above.

Embodiment 2

In the first embodiment, sheets are discharged into the processing tray 130, and aligned there, after the position of the aligning member 141 or 142, which is to serve as the sheet alignment reference, is changed. However, sheets may be aligned first, and then shifted to a location different from the location to which the immediately preceding set of sheets is shifted, before it is discharged from the processing tray 130.

Figure 36:
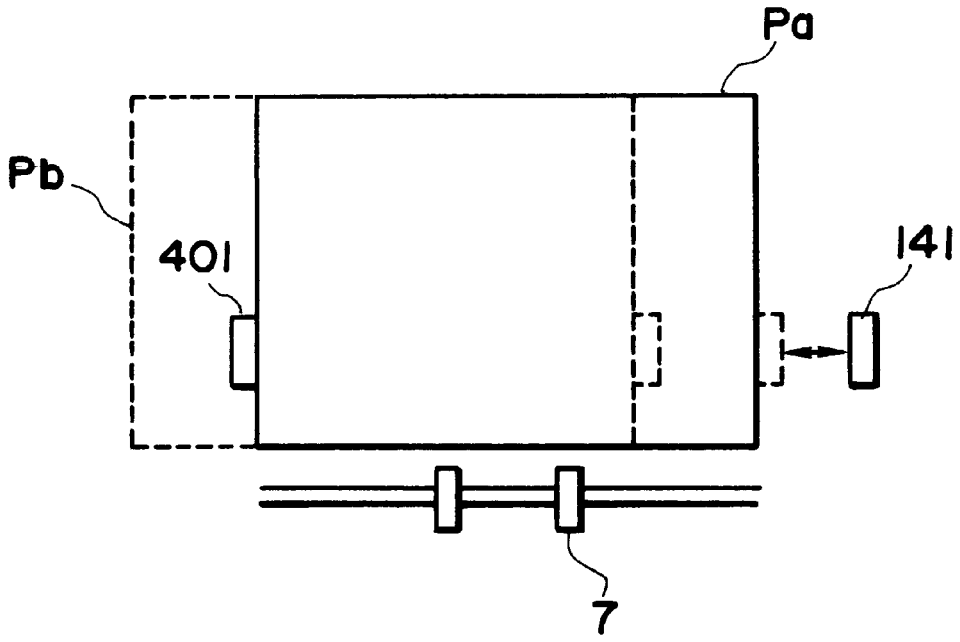
FIG. 36 is a top view of the processing tray and its adjacencies in the second embodiment of the present invention.
Figure 37:
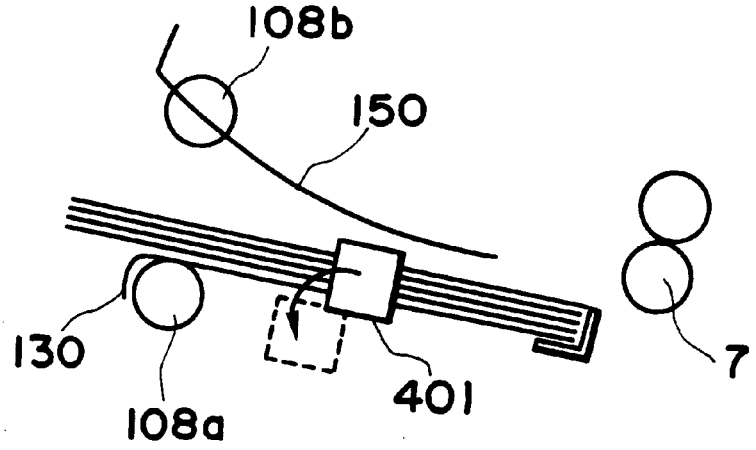
FIG. 37 is a side view of the processing tray and its adjacencies in the second embodiment of the present invention.
Figure 38:
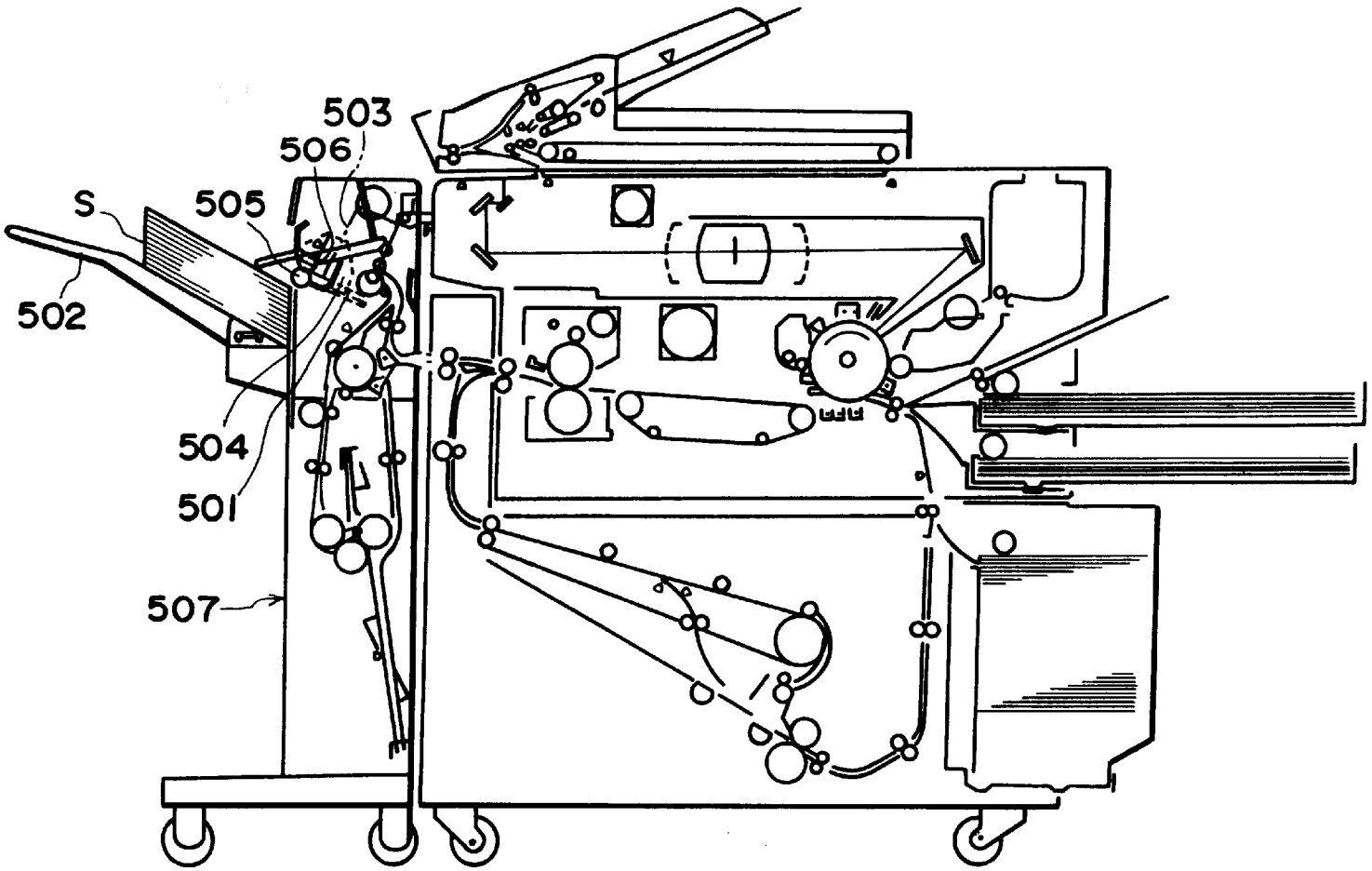
PRIOR ART FIG. 38
FIG. 38 is a vertical section of a sheet processing apparatus based on the prior art, and an image forming apparatus comprising such a sheet processing apparatus.

Referring to FIG. 36, in this embodiment, after being discharged into the processing tray 130, a relatively small number of sheets, or a sub-set of sheets, is placed squarely in contact with an aligning reference wall 401 by an aligning wall 141, becoming aligned at a location Pa. As soon as the aligning of a predetermined, relatively small, number of sheets is completed, the aligning reference wall 401 is rotated by the function of a solenoid (unillustrated) to a position below the processing tray 130 as illustrated in FIG. 37.

Then, the sub-set of the aligned sheets is pushed a predetermined distance by the aligning wall 141, to a location Pb. Then, the oscillating guide 150 is lowered onto the sheets, and discharges the set of the aligned sheets into the stacking tray 200. After all the sheets in the currently processed set are discharged, the sheets of the next set are discharged from the location Pa, without being shifted to the location Pb, so that they are stacked in a staggered arrangement relative to the sheets in the immediately preceding set as they are discharged into the stacking tray 200.

While the invention has been described with reference to the structures disclosed herein, it is not confined to the details set forth, and this application is intended to cover such modifications or changes as may come within the purposes of the improvements or the scope of the following claims.

What is claimed is:

1. A sheet processing apparatus comprising:

first stacking means for stacking sheets discharged thereto;

feeding means for feeding sheets from said first stacking means;

second stacking means for stacking the sheets fed by said feeding means;

shifting means for shifting the sheets stacked on said first stacking means; and control means for grouping the sheets in a set into a plurality of groups of sheets, and stacking, shifting and feeding the sheets, for each group, to said first stacking means, and for stacking the set of sheets on said second stacking means.

2. An apparatus according to claim 1, wherein said feeding means includes a pair of rotatable members and is openable such that it opens when the sheet is discharged to said first stacking means, and feeds the set of sheets to said second stacking means.

3. A sheet processing apparatus wherein sets of sheets are offset for each set, comprising:

first stacking means for stacking sheets discharged thereto;

feeding means for feeding sheets from said first stacking means;

second stacking means for stacking the sheets fed by said feeding means;

shifting means for shifting the sheets stacked on said first stacking means; and control means for grouping the sheets in a set into a plurality of groups of sheets, stacking of the sheets onto said first stacking means, and feeding the sheets onto said second stacking means, said control means controlling said shifting means to offset each group of a first set of sheets relative to each group of a second set of sheets to stack the first set of sheets and the second set of sheets at offset positions on said second stacking means.

4. An apparatus according to claim 3, wherein said shifting means functions also as means for aligning the sheets.

5. An apparatus according to claim 4, wherein said shifting means includes a pair of aligning members for shifting the sheets in a direction crossing with a direction of sheet discharge, and wherein when one of said pair of aligning members is set at an aligning position or is retracted from the aligning position, an other of said pair of aligning members moves, for each discharge of sheet, to urge the sheet to said one of said pair of aligning members placed at the aligning position, and wherein when said aligning members, after their alignment operation, either retracts said one of said pair of aligning members and shifts the set of sheets or returns said one of said pair of aligning members at the aligning position, in accordance with whether the set of sheet is the first set of sheets or the second set of sheets.

6. An apparatus according to claim 5, wherein said second stacking means is disposed downstream of said first stacking means, and said first and second stacking means are inclined such that downstream sides thereof take upper positions, and wherein said second stacking means lowers in accordance with an amount of the sets of sheets stacked thereon.

7. An apparatus according to claim 4, wherein said shifting means includes a pair of aligning members for shifting the sheets in a direction crossing with a direction of sheet discharge, and wherein one of said aligning members is set at different positions for the first set of sheets and the second set of sheets, and the other of said pair of aligning members moves, for each discharge of sheet, to urge the sheet to said one of said aligning members.

8. An apparatus according to claim 7, wherein said second stacking means is disposed downstream of said first stacking means, and said first and second stacking means are inclined such that downstream sides thereof take upper positions, and wherein said second stacking means lowers in accordance with an amount of the sets of sheets stacked thereon.

9. An apparatus according to claim 8, wherein said feeding means includes a pair of rotatable members and is openable such that it opens when the sheet is discharged to said first stacking means, and feeds the set of sheets to said second stacking means.

10. An apparatus according to claims 1 or 9, further comprising a temporary stacking portion for temporarily stacking a plurality of sheets in a sheet passage before said first stacking means, wherein after the set of sheets on said first stacking means is discharged, the set of sheets on said temporary stacking means are discharged to said first stacking means.

11. A sheet processing apparatus comprising:

first stacking means for stacking sheets discharged thereto;

feeding means for feeding a set of sheets from said first stacking means;

second stacking means for stacking the set of sheets fed by said feeding means;

aligning means for aligning the sheets stacked on said first stacking means;

control means for grouping the sheet in a set into a plurality of groups of sheets, and stacking, aligning and feeding the sheets, for each group, to said first stacking means, and for stacking the set of sheets on said second stacking means.

12. An apparatus according to claim 11, wherein said second stacking means is disposed downstream of said first stacking means, and said first and second stacking means are inclined such that downstream sides thereof take upper positions, and wherein said second stacking means lowers in accordance with an amount of the sets of sheets stacked thereon.

13. An image forming apparatus comprising:

a sheet processing apparatus as defined in any one of claims 1, 3 or 11; and, means for forming an image on the sheets, which is discharged to said first stacking means.

14. An apparatus according to claim 12, wherein said feeding means includes a pair of rotatable members and is openable such that it opens when the sheets discharged to said first stacking means, and feeds the set of sheets to said second stacking means.

15. An apparatus according to claim 11, wherein said control means controlling said shifting means to stack a set of sheets and a set of sheets at offset positions on said stacking means.

16. An apparatus according to claims 4 or 15, further comprising binding means for binding the set of sheets on said first stacking means, and the aligning position of said aligning means are different in an operation mode wherein the sheets are bound and in an operation mode wherein the sheets are not bound by said binding means.

17. An apparatus according to claim 15, wherein said aligning means includes a pair of aligning members for shifting the sheets in a direction crossing with a direction of sheet discharge, wherein one of said aligning members is set at an aligning position or is retracted from the aligning position, the other aligning member moves, for each discharge of sheet, to urge the sheet to said one of aligning members placed at the aligning position, and wherein said aligning means, after its alignment operation, retracts said one of said aligning members and shifts the set of sheets or retaining said one of said aligning members at the aligning position, in accordance with whether the set of sheets is the set of sheets or the second set of sheets.

18. An apparatus according to claim 15, wherein said aligning means includes a pair of aligning members for shifting the sheets in a direction crossing with a direction of sheet discharge, wherein one of said aligning members are set at different positions for the set of sheets and the set of sheets, and the other aligning member moves, for each discharge of sheet, to urge the sheet to said one of aligning members.

19. An apparatus according to claim 18, wherein said second stacking means is disposed downstream of said first stacking means, and said first and second stacking means are inclined such that downstream sides thereof take upper positions, and wherein said second stacking means lowers in accordance with an amount of the sets of sheets stacked thereon.

20. An apparatus according to claim 19, wherein said feeding means includes a pair of rotatable members and is openable such that it opens when the sheet is discharged to said first stacking means, and feeds the set of sheets to said second stacking means.

21. An apparatus according to claims 7 or 18, wherein the aligning positions are changed in accordance with to positions corresponding to binding positions where said binding means binds the sheets.

22. An apparatus according to claim 21, wherein the binding positions includes positions for two-position stapling and one position stapling.

* * * * *

UNITED STATES PATENT AND TRADEMARK OFFICE

CERTIFICATE OF CORRECTION

PATENT NO. : 6,241,234 B1
DATED : June 5, 2001
INVENTOR(S) : Naho Saitoh et al.

It is certified that error appears in the above-identified patent and that said Letters Patent is hereby corrected as shown below:

Title page,
Item [30], insert: -- [30] Foreign Application Priority Data
Dec. 27, 1996 (JP) .... 8-349416
Dec. 27. 1996 (JP) .... 8-350598 --.

Column 8,
Line 58, "tray130" should read -- tray 130 --.

Column 10,
Line 35, "(outline" should read -- (outlined --.
Line 43, "is" should read -- are --.

Column 11,
Line 49, "thenumber" should read -- the number --.

Column 13,
Line 60, "sheet" should read -- sheets --.

Column 14,
Line 1, "illustrate din" should read -- illustrated in --.
Line 34, "trialing" should read -- trailing --.

Column 15,
Line 45, "in" (1st occurrence) should be deleted.

Column 16,
Line 38, "trialing" should read -- trailing --.

Column 17,
Line 46, "maintaining" should read -- maintain --.

Column 18,
Line 41, "tacking" should read -- stacking --.

UNITED STATES PATENT AND TRADEMARK OFFICE

CERTIFICATE OF CORRECTION

PATENT NO. : 6,241,234 B1
DATED : June 5, 2001
INVENTOR(S) : Naho Saitoh et al.

It is certified that error appears in the above-identified patent and that said Letters Patent is hereby corrected as shown below:

Column 19,
Line 30, "As" should read -- At --.
Line 45, "trialing" should read -- trailing --.

Column 20,
Line 33, "for shifting the sheets stacked on said first" should read -- having a first aligning member and a second aligning member for moving the sheets on said first stacking means independently from each other, said aligning members aligning the sheets by sandwiching the sheets by the first and second aligning members. --.
Line 34, "stacking means; and" should be deleted.
Line 35, "grouping the sheets in a set into a" should read -- controlling said aligning members to offset sets of the sheets stacked on said second stacking means by shifting an aligning position of said aligning members in a direction perpendicular to a direction of feeding of the sheets, for each set of sheets. --.
Line 36-39, should be deleted.

Column 21,
Line 6, "an other" should read -- another. --
Line 14, "sheet" should read -- sheets --.
Line 50, "a set of" should be deleted.
Line 52, "set of" should be deleted.
Line 57, "grouping the sheet in" should read -- dividing --.
Line 57, "set" should read -- set of the sheets --.
Line 58, "groups of" should read -- groups, each containing at least two --.
Line 58, "and stacking," should read -- for --.
Line 58, "and" (2nd occurrence) should be deleted.
Line 59, "feeding" should be deleted, and "sheets," should read -- sheets --.
Line 59, "group, to said first stacking" should read -- group of the sheets after the set is stacked on said first stacking means, and for causing the feeding means to feed the set to said second stacking means. --.
Line 60, "means, and for stacking the sets of sheets on said second" should be deleted.
Line 61, "stacking means." should be deleted.
Lines 62-65, should be deleted.

UNITED STATES PATENT AND TRADEMARK OFFICE

CERTIFICATE OF CORRECTION

PATENT NO. : 6,241,234 B1
DATED : June 5, 2001
INVENTOR(S) : Naho Saitoh et al.

It is certified that error appears in the above-identified patent and that said Letters Patent is hereby corrected as shown below:

Column 22,
Lines 1-3, should be deleted.
Line 9, "12," should read -- 11, --.
Lines 14-17, claim 15 should be deleted.
Line 18, "4 or 15," should read -- 4, --.
Lines 24-36, claim 17 should be deleted.
Lines 37-44, claim 18 should be deleted.
Line 57, "7 or 18," should read -- 7, --.
Line 62, "includes" should read -- include --.

Signed and Sealed this

Thirtieth Day of April, 2002

*Attest:*

*Attesting Officer*

JAMES E. ROGAN
*Director of the United States Patent and Trademark Office*